US006702248B2

(12) United States Patent
Treat

(10) Patent No.: US 6,702,248 B2
(45) Date of Patent: Mar. 9, 2004

(54) BLAST AERATOR WITH SPRINGLESS, PNEUMATICALLY DAMPENED ACTUATOR

(75) Inventor: Rodney D. Treat, Benton, AR (US)

(73) Assignee: Global Manufacturing, Inc., Little Rock, AR (US)

( * ) Notice: Subject to any disclaimer, the term of this patent is extended or adjusted under 35 U.S.C. 154(b) by 0 days.

(21) Appl. No.: 10/341,052

(22) Filed: Jan. 13, 2003

(65) Prior Publication Data

US 2003/0132242 A1 Jul. 17, 2003

Related U.S. Application Data

(60) Provisional application No. 60/350,250, filed on Jan. 16, 2002.

(51) Int. Cl.[7] ..... F16K 31/12
(52) U.S. Cl. ..... 251/28; 251/63.5
(58) Field of Search ..... 251/28, 63.5

(56) References Cited

U.S. PATENT DOCUMENTS

| | | | | | |
|---|---|---|---|---|---|
| 3,788,527 | A | | 1/1974 | Matson | |
| 3,915,339 | A | * | 10/1975 | Matson | 222/3 |
| 3,942,684 | A | * | 3/1976 | Stetson | 222/3 |
| 4,051,982 | A | * | 10/1977 | Stetson | 222/195 |
| 4,197,966 | A | | 4/1980 | Wadensten | |
| 4,346,822 | A | * | 8/1982 | Wadensten et al. | 222/195 |
| 4,449,644 | A | * | 5/1984 | Matson | 222/3 |
| 4,469,247 | A | * | 9/1984 | Tompkins | 222/3 |
| 4,496,076 | A | * | 1/1985 | Tompkins | 222/3 |
| 4,676,402 | A | | 6/1987 | Stetson | |
| 4,703,869 | A | * | 11/1987 | De Rooy | 222/3 |
| 4,767,024 | A | * | 8/1988 | Rappen | 222/3 |
| 4,817,821 | A | * | 4/1989 | Simoens | 222/3 |
| 4,826,051 | A | * | 5/1989 | Milian | 222/195 |
| 4,880,147 | A | * | 11/1989 | Tolan | 222/195 |
| 5,143,256 | A | * | 9/1992 | Wadensten | 222/3 |
| 5,441,171 | A | * | 8/1995 | Maury | 222/3 |
| 5,517,898 | A | * | 5/1996 | Kim et al. | 91/24 |
| 5,715,861 | A | * | 2/1998 | Williams | 137/467 |
| 5,762,103 | A | * | 6/1998 | Gregoire | 137/512.15 |
| 5,853,160 | A | * | 12/1998 | Hurdis et al. | 251/30.02 |
| 5,957,464 | A | * | 9/1999 | Elliott | 277/608 |
| 6,321,939 | B1 | * | 11/2001 | Treat et al. | 222/2 |

* cited by examiner

*Primary Examiner*—Philippe Derakshani
(74) *Attorney, Agent, or Firm*—Stephen D. Carver

(57) ABSTRACT

A quick acting blast aerator comprising a spring-less actuator triggered by an exhaust valve. The actuator valve comprises a tubular body, an exhaust vent defined in the body, a dampening passageway, and a piston slidably disposed therewithin for movement between a tank filling position and a displaced, air discharge position. Preferably the piston has a projecting dampener which engages the dampening passageway. The trigger valve comprises a rigid, cylindrical housing with a hollow interior having a plurality of vent orifices radially disposed about its periphery. A pair of resilient bands surrounding the housing cover the vent orifices to form a one-way check valve. A resilient, hollow piston coaxially, slidably disposed within the trigger housing has a hollow internal chamber containing a ball valve. Mutual cooperation of the trigger piston and its internal valve govern pneumatically control the actuator.

4 Claims, 23 Drawing Sheets

BLAST AERATOR WITH SPRINGLESS, PNEUMATICALLY DAMPENED ACTUATOR

CROSS REFERENCE TO RELATED APPLICATION

This utility patent application is based upon previously-filed, pending U.S. Provisional Patent application Serial No. 60/350,250, which was officially filed Jan. 16, 2002, entitled Quick Release Blast Aerator Trigger Valve, and priority based upon said related prior application is hereby claimed.

BACKGROUND OF THE INVENTION

I. Field of the Invention

This invention relates generally to air-accumulator and discharge devices of the type generally known as air blasters, air cannons, or blast aerators. More particularly, the present invention relates to heavy duty blast aerators of the type classified in United States Patent Class 222, Subclasses 2, 3 and 195 and Class 251, Subclass 30.02.

II. Description of the Prior Art

As is well known to those with skill in the art, the passage of bulk materials through conventional handling equipment is often degraded or interrupted. Typical bulk materials comprise concrete mixtures, grains, wood chips or other granular materials disposed within large hoppers or storage bins. In conventional, conically shaped hoppers, for example, bridges or arches of bulk materials often form, preventing or minimizing the orderly flow or delivery of granular materials. Often, "rat holes" or funnels build up, and material passage is severely degraded or halted altogether. Particles of bulk material may form obstructive bonds by adhesion due to chemical or hydrostatic attraction. Particles may also interlock because of horizontal and vertical compression. Such materials usually tend to cake or congeal during bulk processing. When moisture accumulates, unwanted caking tends to block flow. It is also recognized that friction between bulk material and the walls of a typical bunker or hopper in which the material is confined decreases flow efficiency.

Blast aerators or air cannons have long been employed to dislodge blocked or jammed bulk material. Storage bins or hoppers, for example, are often fitted with one or more high pressure air cannons that periodically blast air into the interior to dislodge caked particles, break funnels and bridges, and destroy rat holes. Bulk flow problems can temporarily be stopped by physically vibrating the hopper or container to shake loose the jammed materials. But not all materials may be dislodged in this manner. For example, large concrete bunkers may be impossible to vibrate. Materials like soft wood chips ordinarily absorb vibratory energy and must be dislodged by other methods.

In many applications air blasters are preferred over vibrators because of efficiency. The forces outputted by blast aerators are applied directly to the material to be dislodged, rather than to the walls of the structure. Modern air blasters usually outperform over air slides, air wands, and various air screen devices which operate at low pressures. Live bottoms in hoppers or bins are limited in their effectiveness, since they may tend to create bridging or arching of material. Modern air cannons or blast aerators are intended for use as a flow stimulator against materials that are primarily moved by gravity. They are not intended to be the prime movers of such materials, and for safety purposes they should not be used to initiate the flow or movement of bulk materials unless a gravity feed is employed.

Typical blast aerators comprise a large, rigid holding tank that relatively slowly accumulates air supplied through conventional high pressure air lines provided at typical industrial facilities. A special valve assembly associated with the tank includes a high volume discharge opening directed towards or within the target application. The valve assembly periodically activates the air cannon in response to a trigger. When the blaster is detonated, the large volume of air accumulated in the holding tank is rapidly, forcibly discharged within a few milliseconds. Compressed air released by a modern blast aerator strikes the bulk material at a rate of between five hundred feet per second to eight hundred feet per second. Materials exposed to this high volume inrush are forcibly dislodged by impact. The large volume of air outputted by the aerator spreads throughout the bin or hopper, distributing forces throughout the interior that tend to homogenize and dislodge the mixture. The impacting shock wave rapidly destroys any formations of bulk material that might otherwise hinder fluid flow.

After an exhaust blast, the valve apparatus returns to a "fill" position, wherein an internal, displaceable piston typically blocks the aerator blast output path. The cycle repeats as air that has relatively slowly accumulated again within the blaster is subsequently discharged during the next cycle. A variety of methods have been proposed for controlling the aerator valve assemblies. Various means such as electrical solenoids have been provided for allowing or forcing the discharge piston to rapidly retreat from its normally sealed, blocking position abutting the discharge valve passageways.

U.S. Pat. No. 4,469,247, issued Sep. 4, 1984, and owned by Global Manufacturing Inc., discloses a blast aerator for dislodging bulk materials. The blast aerator tank has a blast discharge opening coaxially aligned with its longitudinal axis. The blast discharge assembly comprises a rigid, tubular discharge pipe comprising an internal shoulder that forms a valve seat. A resilient piston coaxially, slidably disposed within the pipe abuts the valve seat to seal the tank during the fill cycle. In the fill position the seal is maintained by a chamfered end of the piston that matingly, sealingly contacts a similarly chamfered seat portion of the valve seat assembly. A cavity at the piston rear is pressurized to close the valve by deflecting the piston. During periodic cycles, discharge occurs in response to cavity venting, whereupon the piston is rapidly displaced away from the valve seat, exposing the discharge pipe opening to the pressurized tank interior.

Blast aerators characterized by the foregoing generalized structure may be seen in U.S. Pat. Nos. 3,651,988; 3,915,339; 4,197,966; 4,346,822; and 5,143,256. Other relevant blast aerator technology may be seen in Great Britain Pat. Nos. 1,426,035 and 1,454,261. Also relevant are West German Patent 2,402,001 and Australian Pat. No. 175,551.

Global Manufacturing patent No. 4,496,076 teaches a method of employing a plurality of air cannons in a controlled array.

In some prior art aerator designs, the piston and valve assembly are disposed at a right angle relative to the discharge flow path. In addition, many blast aerators use a valve assembly that is mounted externally of the accumulator tank. The latter design features are seen in U.S. Pat. Nos. 3,942,684; 4,767,024; 4,826,051; 4,817,821; and 5,853,160.

During the hundreds of thousands of repetitive discharge cycles occurring over the normal life of a typical blast aerator, critical moving parts will inevitably wear and deform. Typical pistons encounter extremely high stresses from heat, friction, and pressure that eventually result in component failure. For example, as the piston deforms or wears, its ability to properly seal during the critical "fill cycle" is impaired. In many prior art designs that portion of the piston utilized to create a seal also functions as the working surface upon which tank pressure acts to force the piston to its rearward "blast" position, further aggravating component stress and shortening valve life. In operation, the piston must rapidly travel away from the seal during the discharge cycle. As it deforms over hundreds of thousands of blast cycles however, it may lose its symmetry, and misalignment within the valve tube can slow piston travel, enlarging the blast time period and denigrating the force of the discharge. When critical structural parts fail, injury to operating personnel may occur. At the very least, aerator component breakdown may severely limit bulk flow efficiency. Therefore some form of dynamic control over the piston that limits stress would seem desirable. Some attempts in this direction are acknowledged.

U.S. Pat. No. 5,441,171 discloses a protrusion on the rear of a slidably captivated piston to help slow the piston after firing. This design does not bleed air off in a controlled fashion and in fact the protrusion does not shut off the flow of air out of the valve body.

U.S. Pat. No. 5,517,898 discloses a pneumatic cylinder in which coaxially disposed "pistons" include dampening sleeves. In other words, ports are interconnected with internal passageways including stem portions of the cylinder to dampen piston movement by compressed air.

The actuator system disclosed in my prior U.S. Pat. No. 6,321,939 that was issued Nov. 27, 2001, includes a dampened, high-speed actuator. A unique, lightweight piston within the actuator is controlled through a dampening arrangement that mitigates piston shock. Special structure protruding from the piston is received within a passageway end cap when the piston is retracted during firing, and special vents govern the rate of air flow and pneumatic equilibrium. Cushioning pressures at the rear of the piston dampen piston movement. A coiled metal spring between the piston and the housing end cap provides additional cushioning.

During firing the spring is compressed at a very rapid rate as the piton retracts. Full compression occurs in approximately 0.01 seconds. Corresponding piston velocity for an aerator with a typical four inch O. D. actuator output pipe is approximately 200 to 250 feet per second. After repetitive cycles at such speeds, the coiled spring may fail, especially in high temperature applications. Spring problems are recognized in the aerator industry with many designs. The coils of the spring are compressed together during firing, generating heat and slowing the piston. This phenomenon degrades the output forces achievable by the air blaster. spring adds cost to the Air Blaster.

It is therefore proposed to provide a "spring-less" air blaster. In other words, separate mechanical springs are omitted from the new design. Instead of a mechanical spring, pneumatic forces are employed for cushioning and dampening. In this "pneumatic design" the actuator valve assembly is controlled by a special trigger. In other words, standard, electrically-operated pneumatic trigger valves have been replaced by my "quick exhaust valve" described in provisional application Serial No. 60/350,250. The actuator system disclosed in prior U.S. Pat. No. 6,321,939 has been modified as described below, and when coupled to the new quick exhaust valve, piston travel and dampening are mitigated by pneumatic forces in the trigger arrangement.

SUMMARY OF THE INVENTION

A blast aerator system with a "spring-less" actuator is triggered by a special quick exhaust valve. The rigid holding tank mounts the actuator at it's discharge end, and the exhaust valve trigger is secured to the opposite end, being coupled to the actuator through an internal pipe coaxially extending through the tank.

The preferred valve assembly includes an internal, slidably mounted piston that normally blocks the exhaust path (i.e., during tank filling). The piston normally contacts an internal valve seat, but when deflected away the exhaust vents are suddenly exposed and discharge occurs. In the high temperature mode, the piston is heat resistant. It is preferably made of 6061-T6 aluminum. The low temperature piston is made from resilient material such as polypropylene. A rigid valve cap closes the valve actuator assembly. The valve cap comprises an upper, dome-like portion and an integral, lower disk portion coaxially fitted to the actuator body. The piston comprises a generally cylindrical dampener that is received within a dampener passageway in the end cap.

The trigger at the opposite end of the tank comprises a symmetrical, ventilated housing that mounts a miniature, hollow, lightweight piston. A plurality of vent orifices radially disposed about the housing periphery, are normally covered by a pair of resilient bands that may be deflected away from the orifices in response to sufficient air pressure, thus functioning as a check valve. The captivated, generally cylindrical piston is lightweight and hollow. An air passageway extending through the trigger piston is controlled by a deflectable ball forming a valve element. The spherical check valve is captivated within a tapered chamber inside the piston for selectively blocking and exposing various air passages through the piston as it contacts or separates itself from an internal valve seat.

The actuator valve assembly and trigger valve assembly are in fluid flow communication. Trapped residual air within the trigger valve serves as a pneumatic spring to resist and dampen movement of the actuator valve piston. The actuator valve piston is effectively cushioned pneumatically by the trigger valve assembly, eliminating the requirement for a separate mechanical spring. Because there is no a need to machine a spring groove in the piston, piston weight and mass can be reduced; the preferred hollow actuator piston is thus capable of faster movements.

Thus a basic object of this invention is to provide a blast aerator with a spring-less actuator valve.

A related object is to provide a blast aerator with a high speed trigger mechanism that obviates the need for mechanical springs in the associated actuator valve assembly.

Another basic object is to provide a highly reliable blast aerator that resists high temperatures and mechanical stresses.

Another object is to provide a blast aerator trigger of the character described that is of minimal volume and weight.

A fundamental object is to provide a highly reliable blast aerator.

A still further object is to speed up the blast aerator charging and discharging cycle.

A still further basic object is to provide a blast aerator trigger of the character described that minimizes the number of required service calls.

A related object is to control piston deterioration by pneumatically cushioning and controlling it during blast discharges.

Another general object of this invention is to provide a pneumatically dampened piston and valve assembly that extends the useful life of the aerator.

A still further object is to further improve the aerator designs of my prior U.S. Pat. No. 6,321,939.

These and other objects and advantages of this invention, long with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
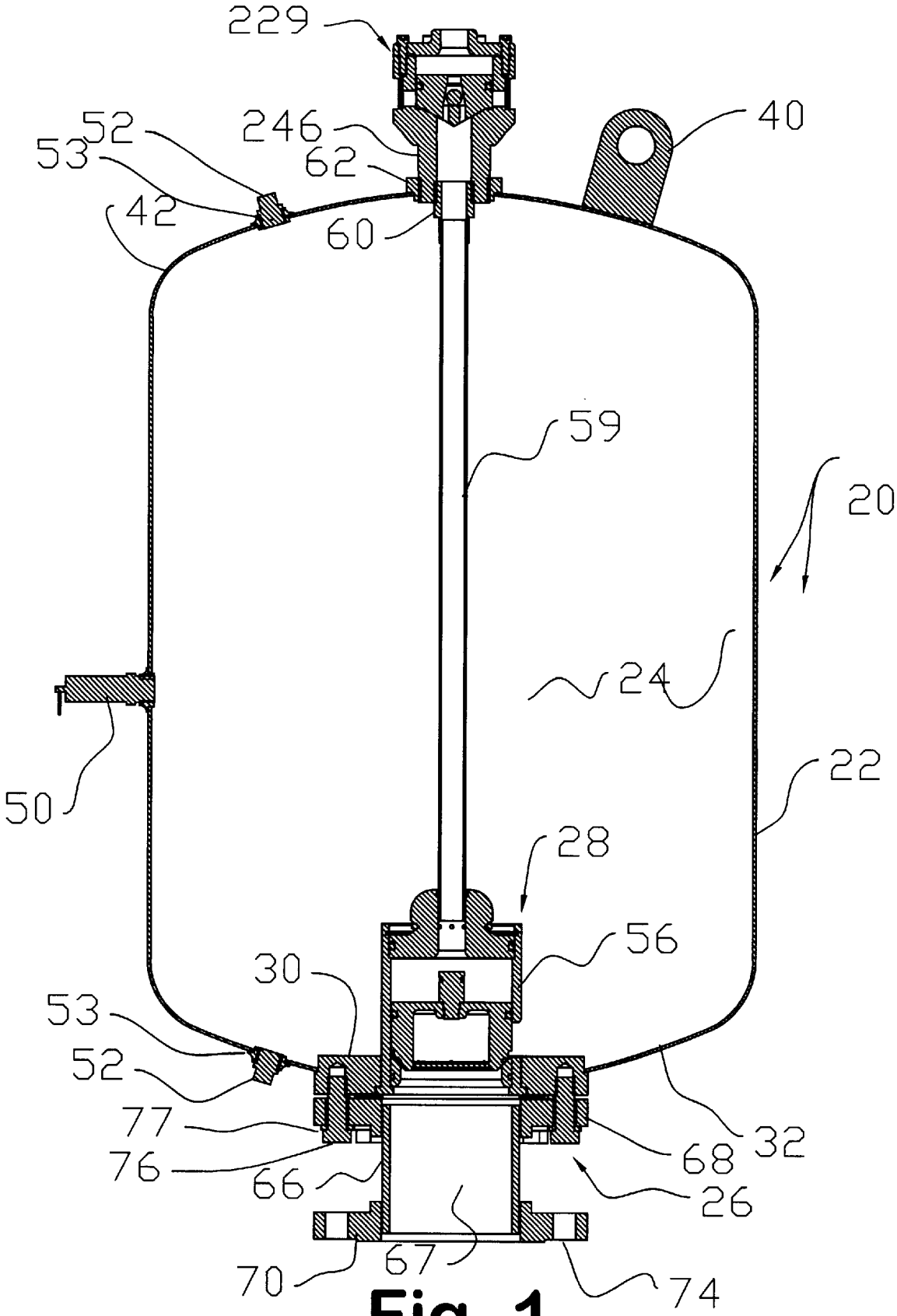
FIG. 1 is a longitudinal sectional view of my new blast aerator.
Figure 2:
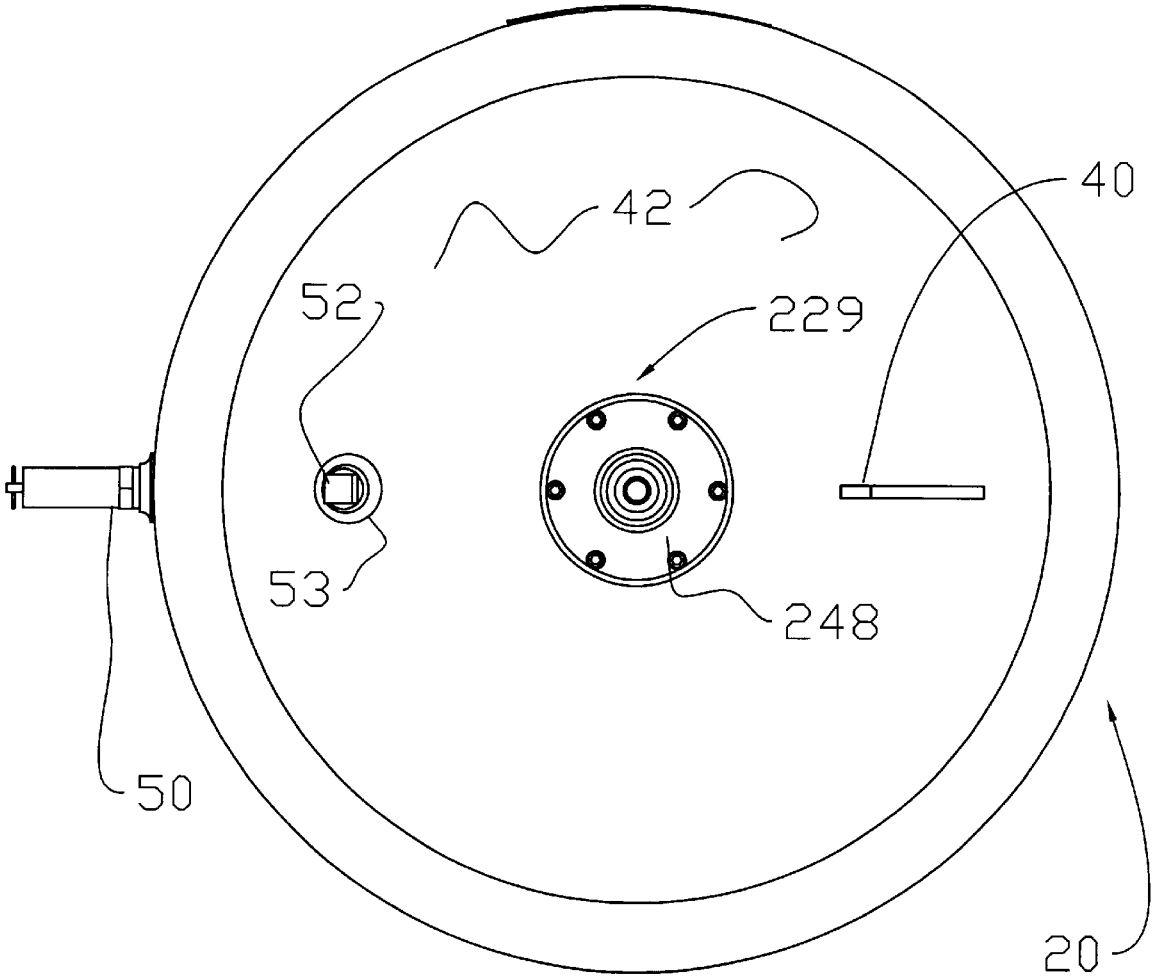
FIG. 2 is a top plan view of the blast aerator of FIG. 1.
Figure 3:
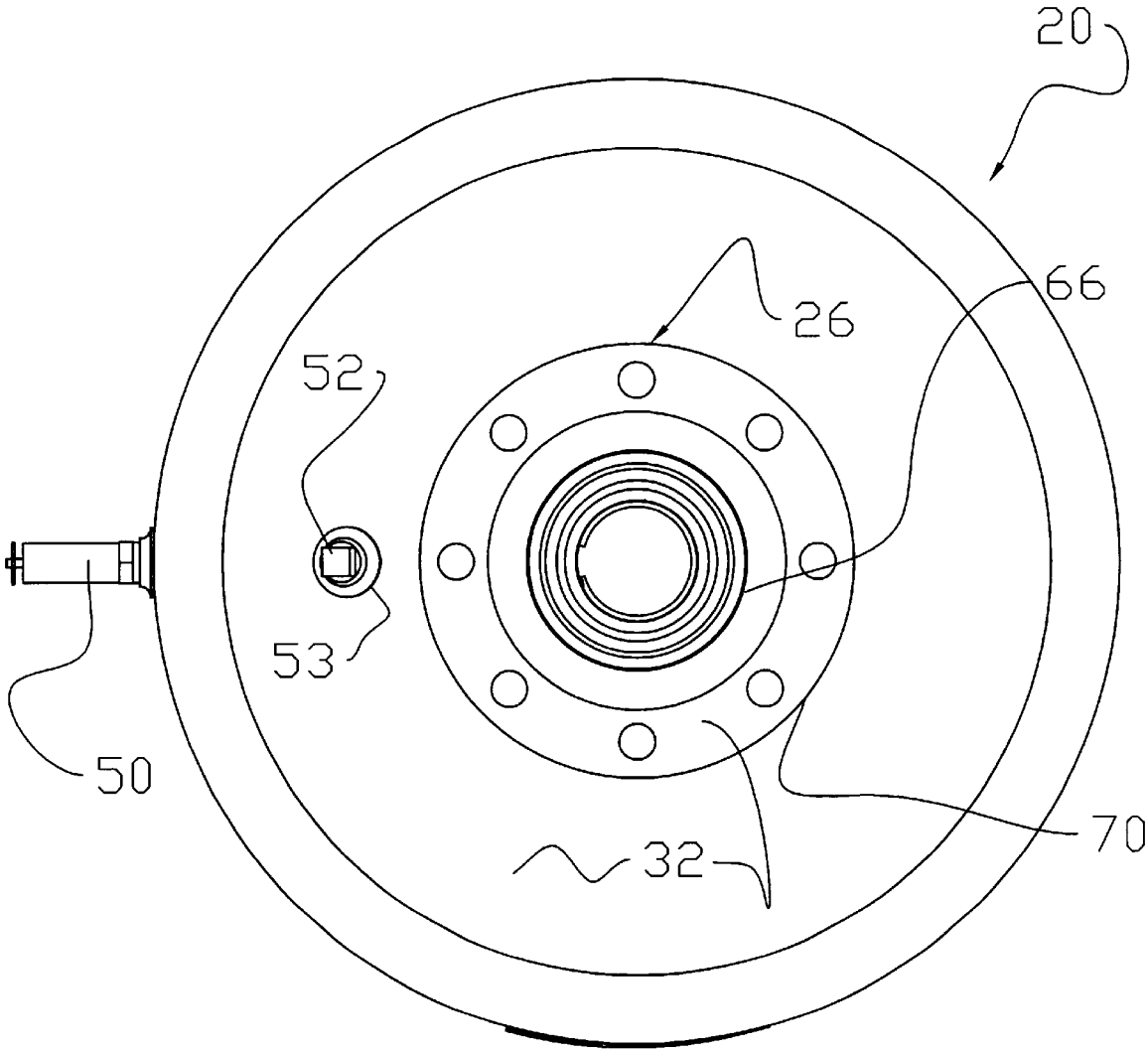
FIG. 3 is a bottom plan view of the aerator of FIG. 1.
Figure 4:
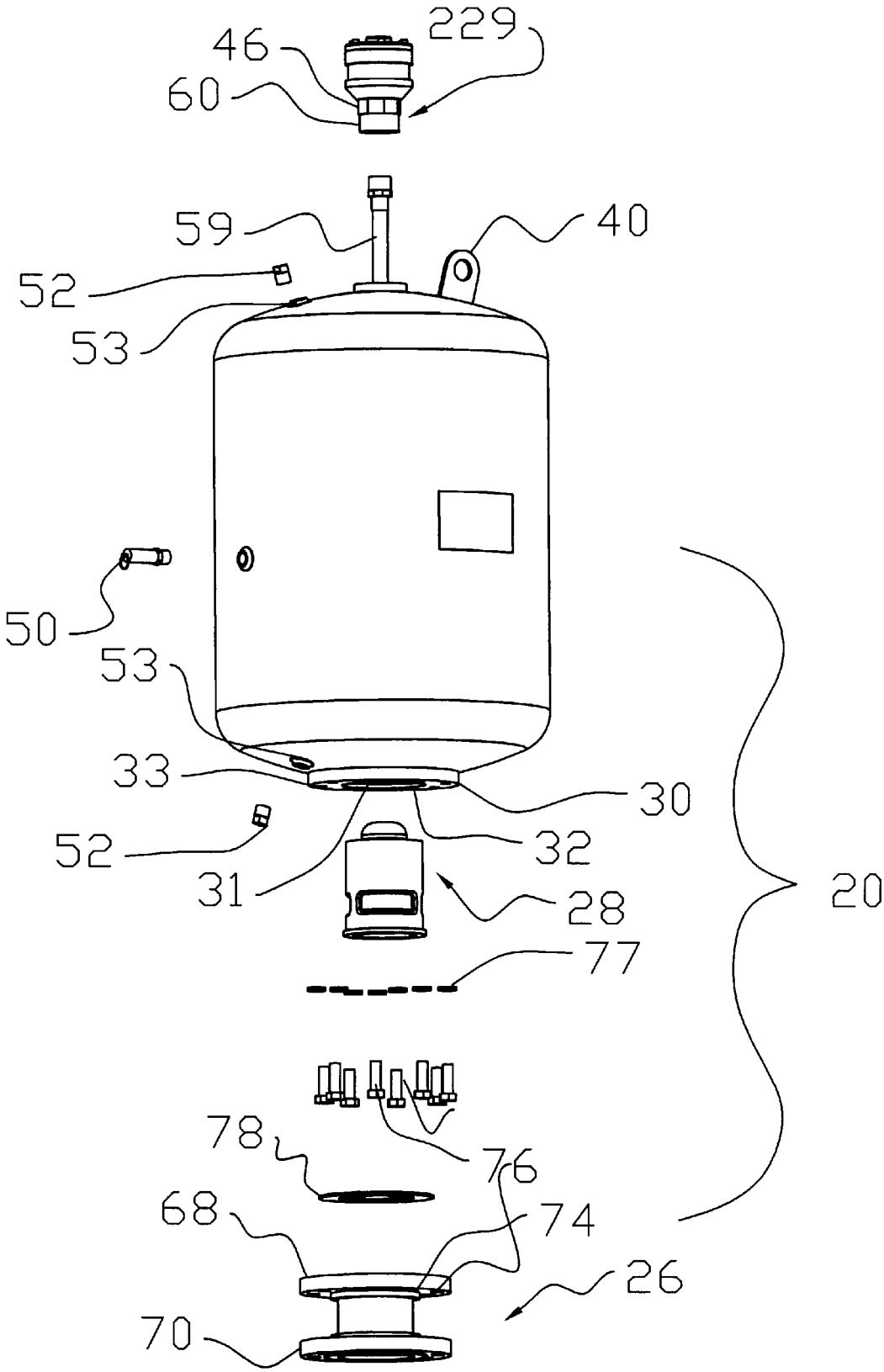
FIG. 4 is an exploded isometric view of the blast aerator assembly.

With initial reference now directed to FIGS. 1–4 of the appended drawings, an improved spring-less blast aerator constructed in accordance with the best mode of the invention has been generally designated by the reference numeral 20. U.S. Pat. No. 6,321,939 issued Nov. 27, 2001 and entitled High Stress Blast Aerator with Dampened Piston, which is owned by Global Manufacturing Inc., the owner of this application, is hereby incorporated by reference for purposes of disclosure.

Aerator 20 comprises a rigid, barrel-like tank 22 of conventional construction that is mounted adjacent or upon a storage bin, hopper or the like. As explained hereinafter, the interior 24 (FIG. 1) of the blast aerator tank 22 accumulates air that is periodically discharged through a standard, twin flange coupling 26 that is coupled through standard pipes recognized by those skilled in the art that extend to the selected bulk material application (i.e., hopper, bin, bulk material storage tank etc.). Air that has accumulated within tank interior 24 is periodically discharged by the spring-less output valve assembly 28, that is preferably coaxially secured within the aerator interior 24 by a rigid mounting flange 30 coaxially disposed at the output end 32 of tank 22.

Figure 5:
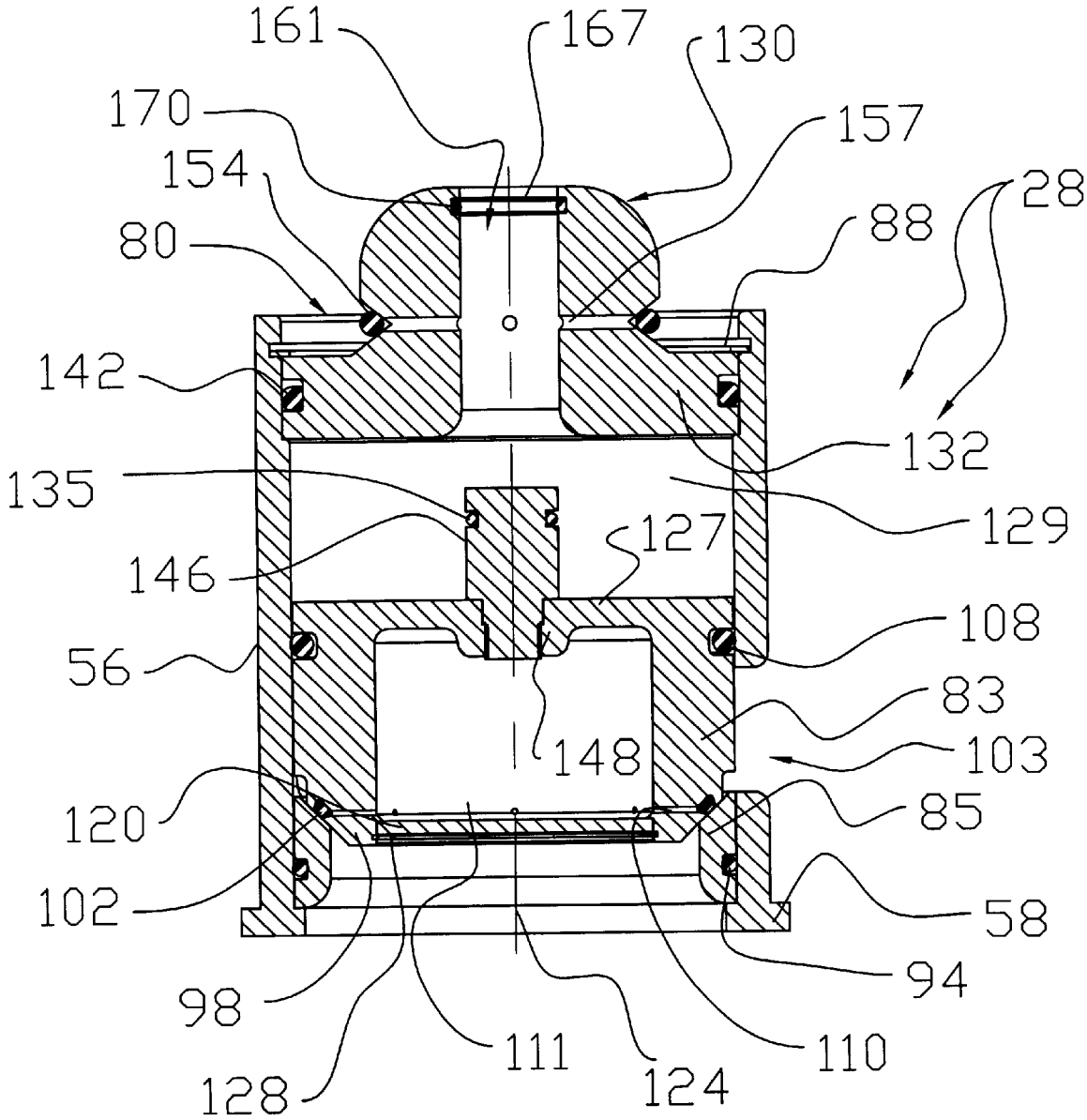
FIG. 5 is an enlarged, fragmentary, sectional view of the spring-less actuator valve assembly.
Figure 6:
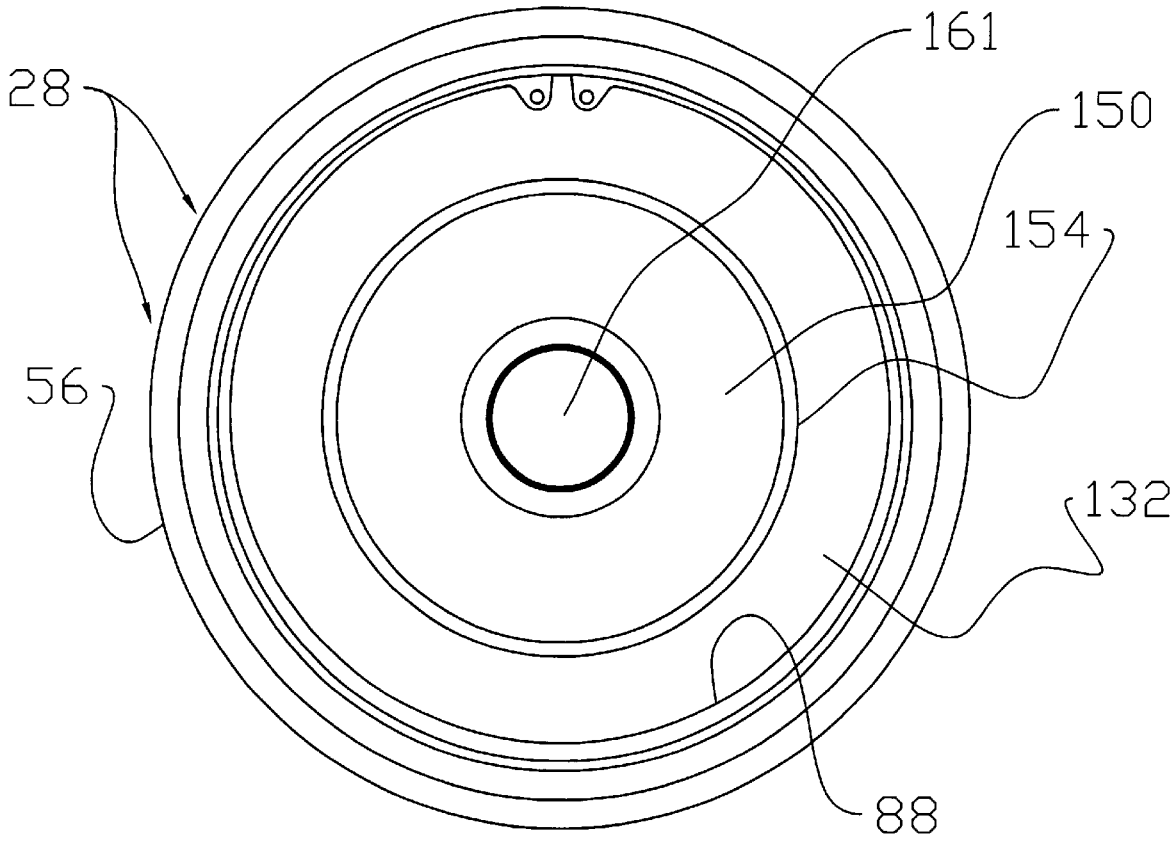
FIG. 6 is a top plan view of the actuator valve assembly seen in FIG. 5.
Figure 7:
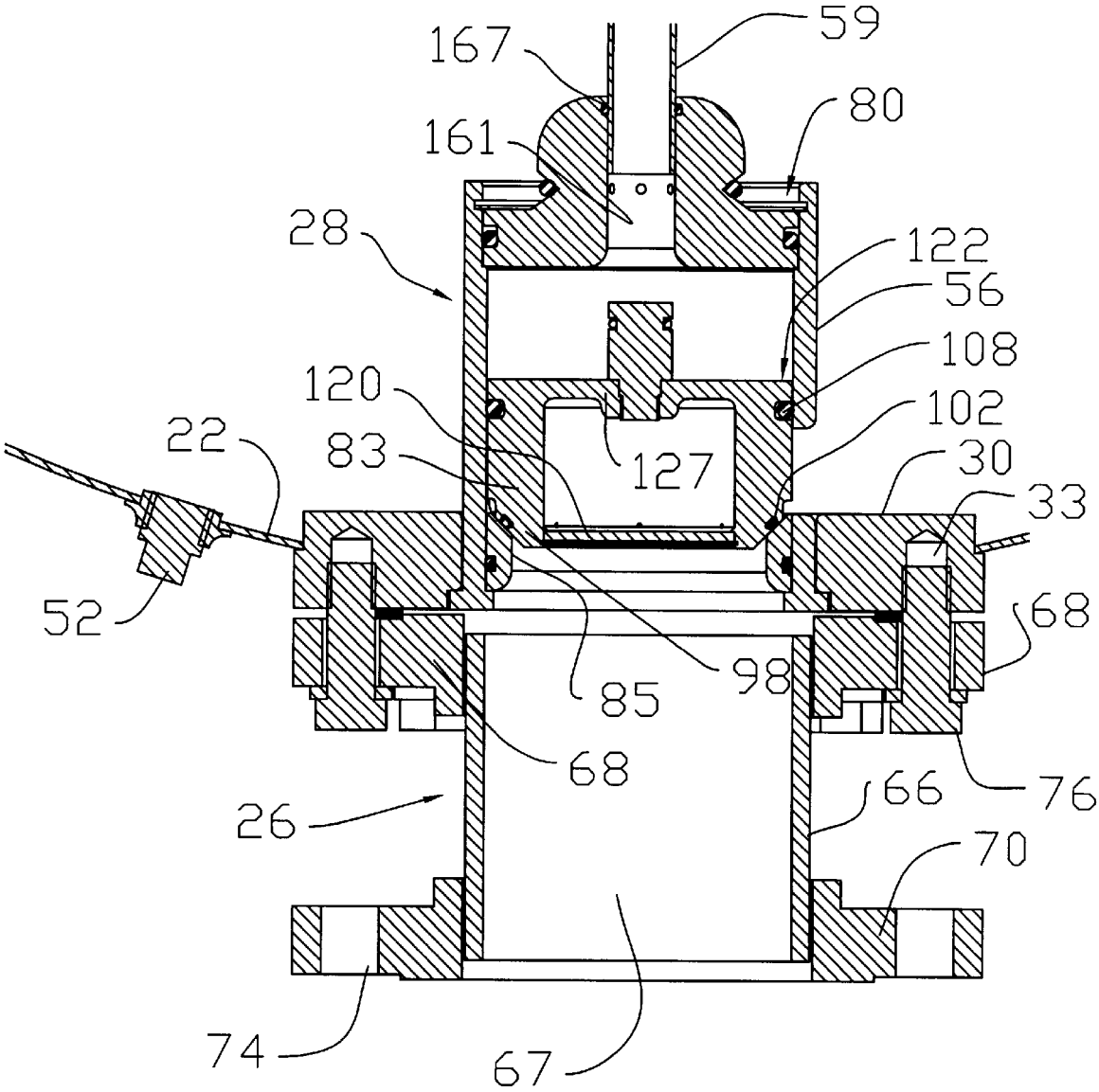
FIG. 7 is an enlarged, fragmentary, longitudinal sectional view of the actuator valve assembly shown coupled to the preferred flanged coupling.
Figure 8:
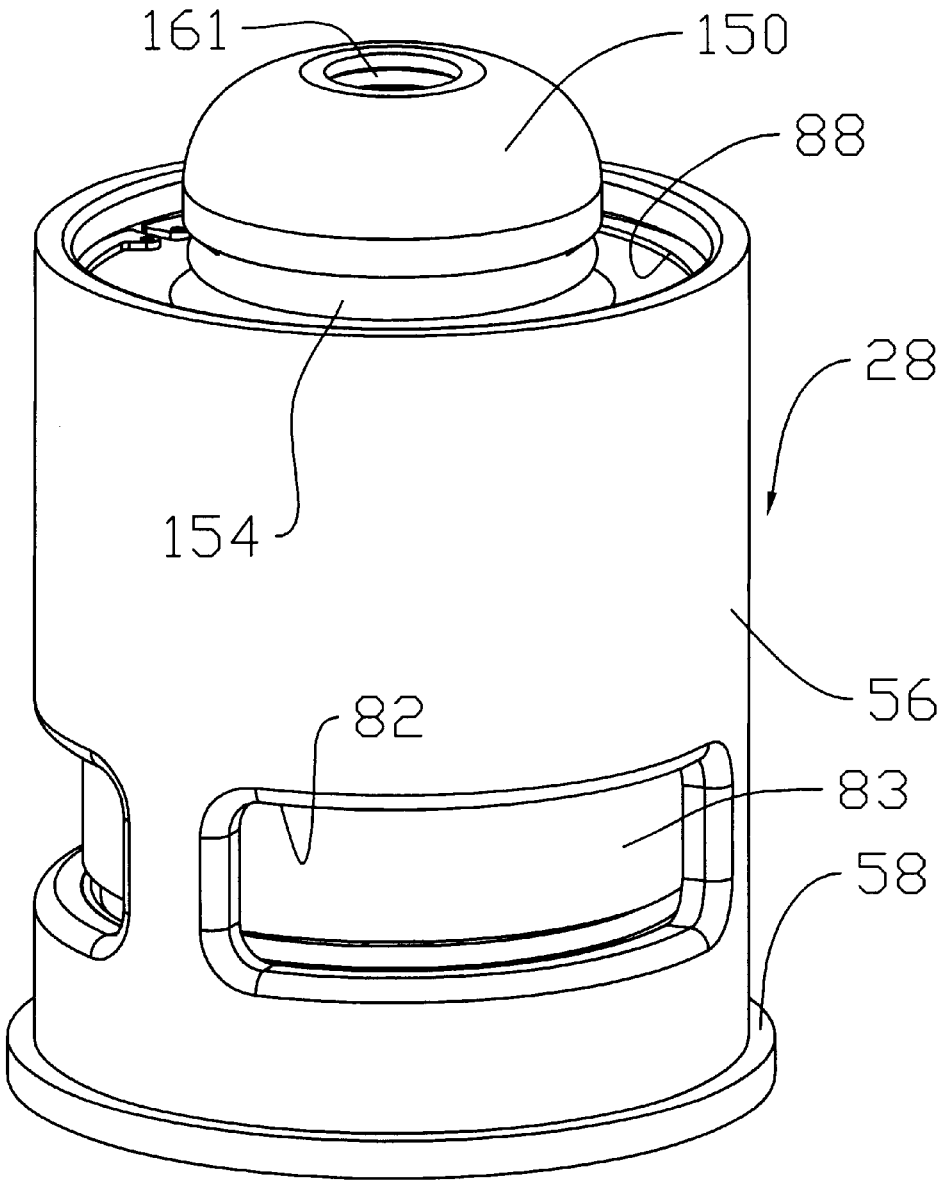
FIG. 8 is an isometric view of the actuator valve assembly.
Figure 9:
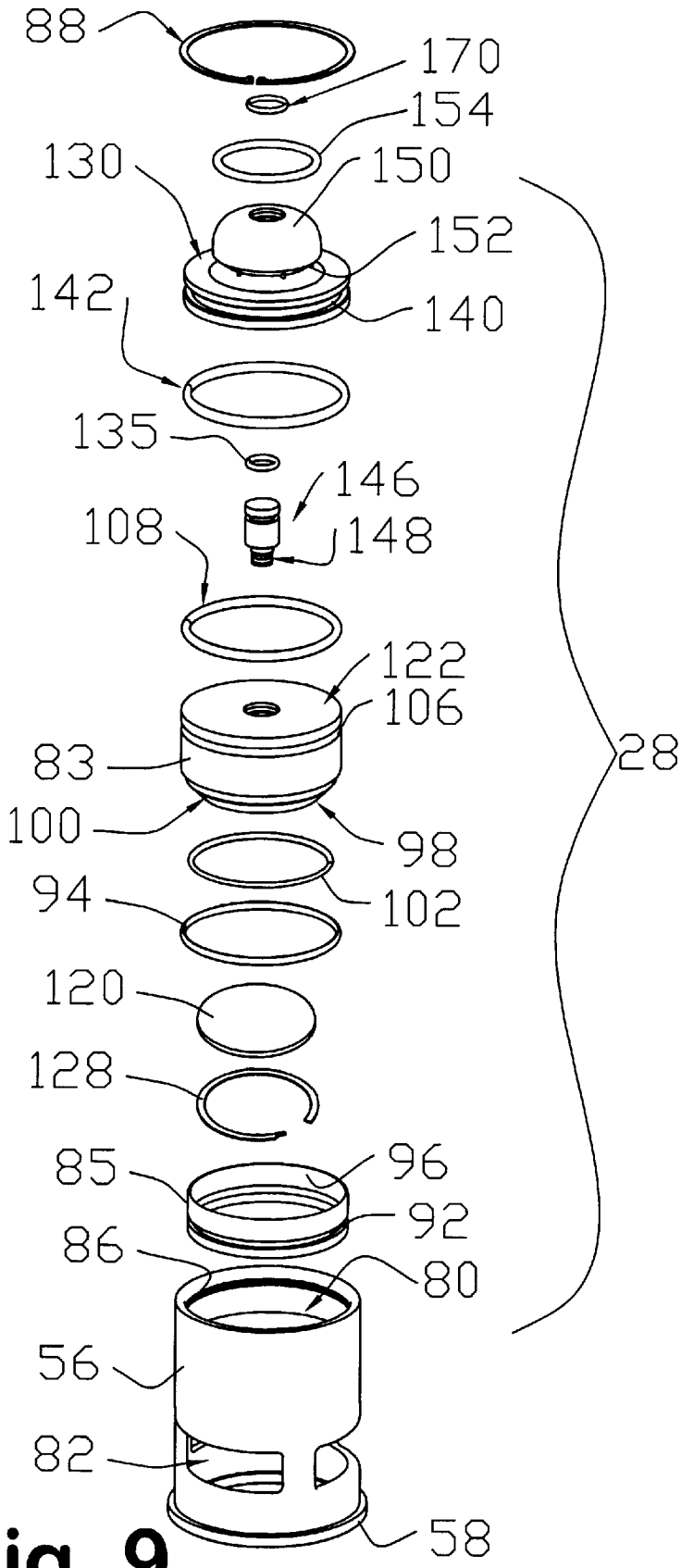
FIG. 9 is an exploded isometric view of the actuator assembly.

Tank 22 can be dimensioned in various sizes and shapes, as will be recognized by those skilled in the art. Preferably, tank 22 comprise a rigid tab 40 welded to its rear end 42 that facilitates mounting and handling. Optionally, a removable tank inspection plug 46 (FIG. 1) and a mating socket 48 may be included for ease of service and maintenance. A high pressure relief valve 50 is preferably threadably attached below plug 46. An auxiliary inspection plug 52 is threadably attached to socket 53 welded to the output end 32 of the tank. As best viewed in FIG. 4, mounting flange 30 has a central aperture 31 through which the output valve assembly 28 is inserted in assembly. Flange 30 comprises a plurality of conventional, radially spaced-apart tapped orifices 33 (FIGS. 4, 7) for threadably receiving conventional mounting bolts. As best seen in FIG. 5, the valve output assembly body 56 has an integral, larger diameter flange portion 58 that concentrically seats within a suitable counterbore (not shown) concentrically defined in tank flange 30.

The quick exhausting trigger assembly 229 sits atop the tank 22 spaced apart from the spring-less actuator assembly 28 and communicates with it via elongated, tubular fill pipe 59 (FIG. 1) that is coaxial with the longitudinal axis of the tank 22. Pipe 59 terminates at bushing 60 that is threadably coupled to rigid socket 62 coaxially welded to the tank rear end 42 (FIG. 1). Trigger assembly 229 initiates operation of the spring-less actuator assembly, which is interconnected though a standard solenoid control valve communicating with a factory source of H.P. air. A suitable conventional electric timer activates the solenoid at selected intervals, typically causing aerator discharge once an hour. Examples of solenoid valve details are seen in prior U.S. Pat. Nos. 4,469,247 and 4,496,076 owned by Global Manufacturing Inc., the assignee herein, which, for disclosure purposes, are hereby incorporated by reference.

With primary reference now directed to FIGS. 1, 3, 4 and 7, the preferred twin flange coupling 26 comprises a rigid, central pipe 66 that coaxially extends between an inner flange 68 and an outer flange 70. Pipe 66 defines a central passageway 67 (FIG. 1) through which large volumes of air are delivered upon aerator activation. Both flanges 68, 70 comprise numerous conventional, radially spaced-apart mounting orifices 74 (FIG. 1) that receive conventional bolts 76 and lock washers 77 (FIG. 4) that secure coupling 26 to tank flange 30. The valve assembly 28 concentrically seats within the counterbore defined in flange 30. Gasket 78 is sandwiched between tank flange 30 and the inner flange 68 of coupling 26.

With emphasis now directed to FIGS. 5–10, the output valve assembly 28 is generally cylindrical in appearance. The elongated, tubular valve body 56 comprises a circumferential flange 58 discussed previously that coaxially seats within tank flange 30 and thus aids in centering and alignment. The opposite, open end 80 exposes the tubular inside of the valve body 56, which generally coaxially receives numerous valve assembly parts to be discussed later. Air accumulated in tank 22 is discharged through exhaust vents 82 (FIGS. 8, 9) defined in valve assembly body 56. A preferably metallic piston 83 that is slidably mounted within valve assembly body 56 normally blocks exhaust vents 82 during the fill cycle. But when deflected away from valve seat 85 the vents 82 are exposed to rapidly vent air from the tank interior 24 to through coupling 26 discussed earlier.

In the best mode, the heat-resistant piston 83 is preferably machined from 6061-T6 aluminum. A low temperature aerator may employ a resilient piston made from material such as polypropylene. Metal coating or chrome plating improves piston wear resistance, and may improve sustained piston operation in very high temperature environments. Various coatings suitable for metallic parts are commercially available, as will be recognized by those with skill in the art, will work. Piston 83 is of relatively low mass, which minimizes inertia, and enables rapid piston movements. It has functioned adequately at temperatures of 400 degrees F. However, aluminum pistons suitable for blast aerator use must be adequately cushioned or dampened during at least a portion of their travel, and means are provided for that purpose as discussed hereinafter.

Figure 10:
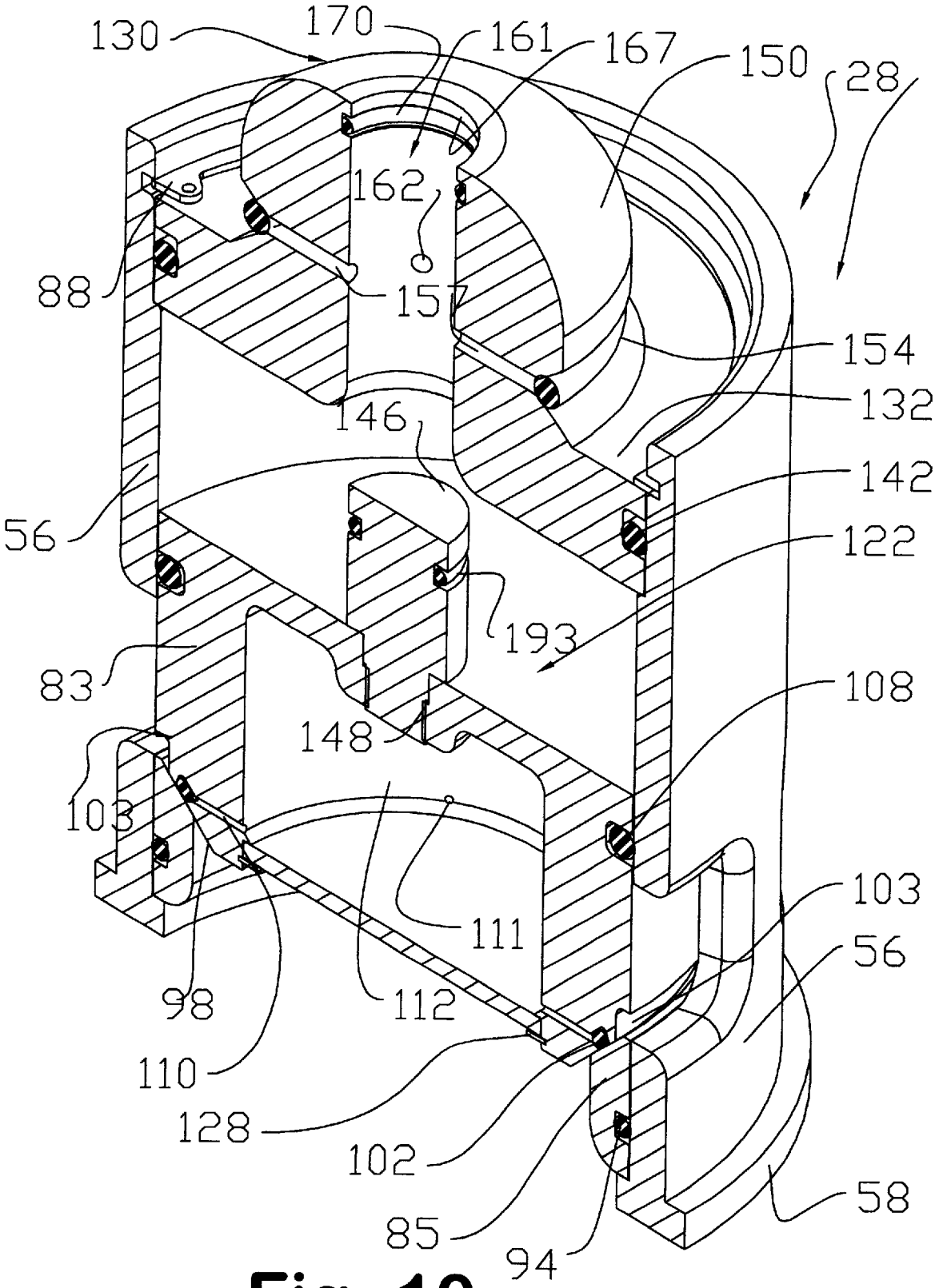
FIG. 10 is an enlarged, partially fragmentary and isometric view of the actuator valve assembly.

An internal ring groove 86 (FIG. 9) defined in the open end 80 of the valve body seats a snap ring 88 that secures the parts together in assembly. Preferable the annular valve seat 85 comprises an external groove 92 that receives a suitable O-ring 94. As best seen in FIGS. 5 and 10, the lowermost portion of the valve seat 85 is urged against and retained by the internal ledge provided by valve body flange 58. The inner end of the valve seat 85 includes an internally beveled or chamfered portion 96 that mates with the tapered end 98 (FIGS. 9, 10) of the piston 83. Piston end 98 (FIG. 9) has a concentric ring groove 100 that receives an O-ring 102 that is spaced apart a from concentric ledge 103 (FIG. 10) circumscribing the piston bottom. Piston ledge 103 is disposed adjacent exhaust vents 82 when the piston is disposed in the "fill" position.

Piston 83 has an upper, coaxially centered ring groove 106 that seats an external O-ring 108. As best seen in FIG. 10, a plurality of radially spaced apart air passageways 110 are defined in the tapered end 98 of the piston 83. These passageways 110 extend between ports 111 in the terminal, interior piston surface 112 (FIG. 10) and the ring groove 100 (FIG. 9) circumscribing the bottom, tapered end 98 of the piston 83. Resilient O-ring 102 normally occupies ring groove 100 to seal the piston against the seat. In operation, when the piston is rapidly deflected, air velocities in the immediate proximity of the piston and O-ring generate high pressures that can dislodge and deform the critical O-ring. The venting passageways 110 dynamically neutralize potentially deforming pressures, thereby preventing unwanted O-ring travel.

Valve cap 130 closes the valve actuator assembly. Concentric, valve cap disk portion 132 comprises an outer ring groove 140 (FIG. 9) that seats an O-ring 142 that seals the valve cap within valve assembly body 56. Snap-ring 88 holds the cap 130 within body 56 notwithstanding pressure from internal spring 128. Importantly, a dampener 146 is secured to the piston's central portion 127, coaxially aligned with longitudinal axis 124 (FIG. 5). The integral, threaded, reduced diameter portion 148 of the plug damper is screwed directly into a suitable passageway 149 (FIG. 9) formed at the piston center.

Valve cap 130 comprises an upper, dome-like portion 150 that is integral with lower disk portion 132. A peripheral, air control ring groove 152 (FIG. 9) forms a boundary between dome 150 and disk portion 132. A resilient, air-control O-ring 154 occupies the air control groove 152, and functions as a one-way valve. A plurality of radially spaced-apart, transverse air passageways 157 extend from the valve cap interior dampening passageway 161 through inlet ports 162 (FIG. 10) to ring groove 152. Air control O-ring 154 is normally captivated within the air control ring groove 152 but functions as a valve, allowing one way air passage by deflecting in response to predetermined air pressure radially applied to it by passageways 157. This facilitates tank filling, as high pressure air entering via pipe 59 (FIG. 1) traverses passageways 157 (FIG. 10), yieldably deflecting the air-control O-ring 154 and filling the aerator tank 22. The dome portion 150 of the valve cap 130 comprises an internal ring groove 167 (FIGS. 7, 10) that seats O-ring 170 to seal inlet pipe 59 (i.e., FIGS. 1, 7) that delivers air to pressurize the interior of the valve assembly.

Figure 17:
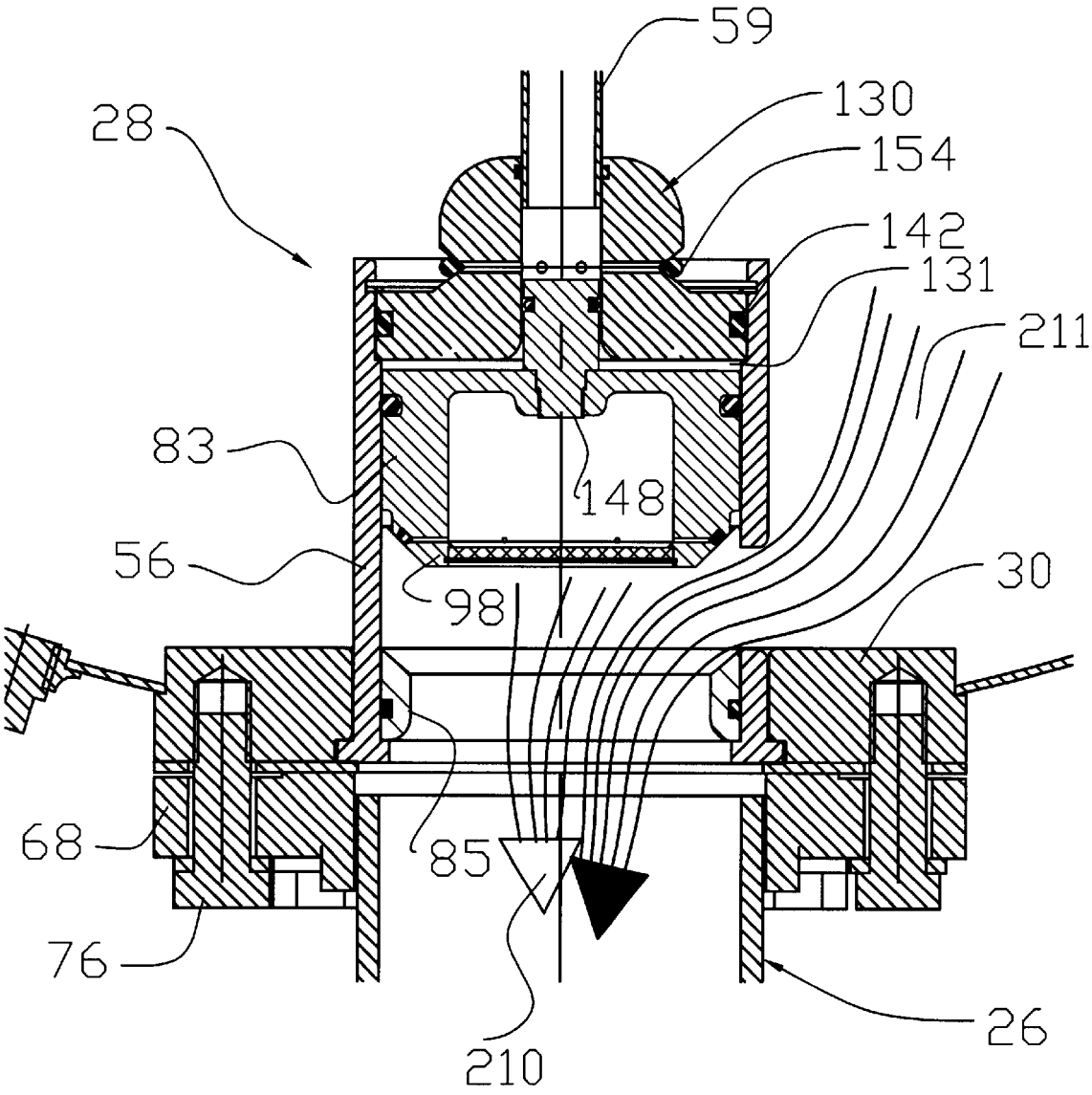
FIG. 17 is a sectional diagrammatic view showing firing of the blaster and actuator.
Figure 18:
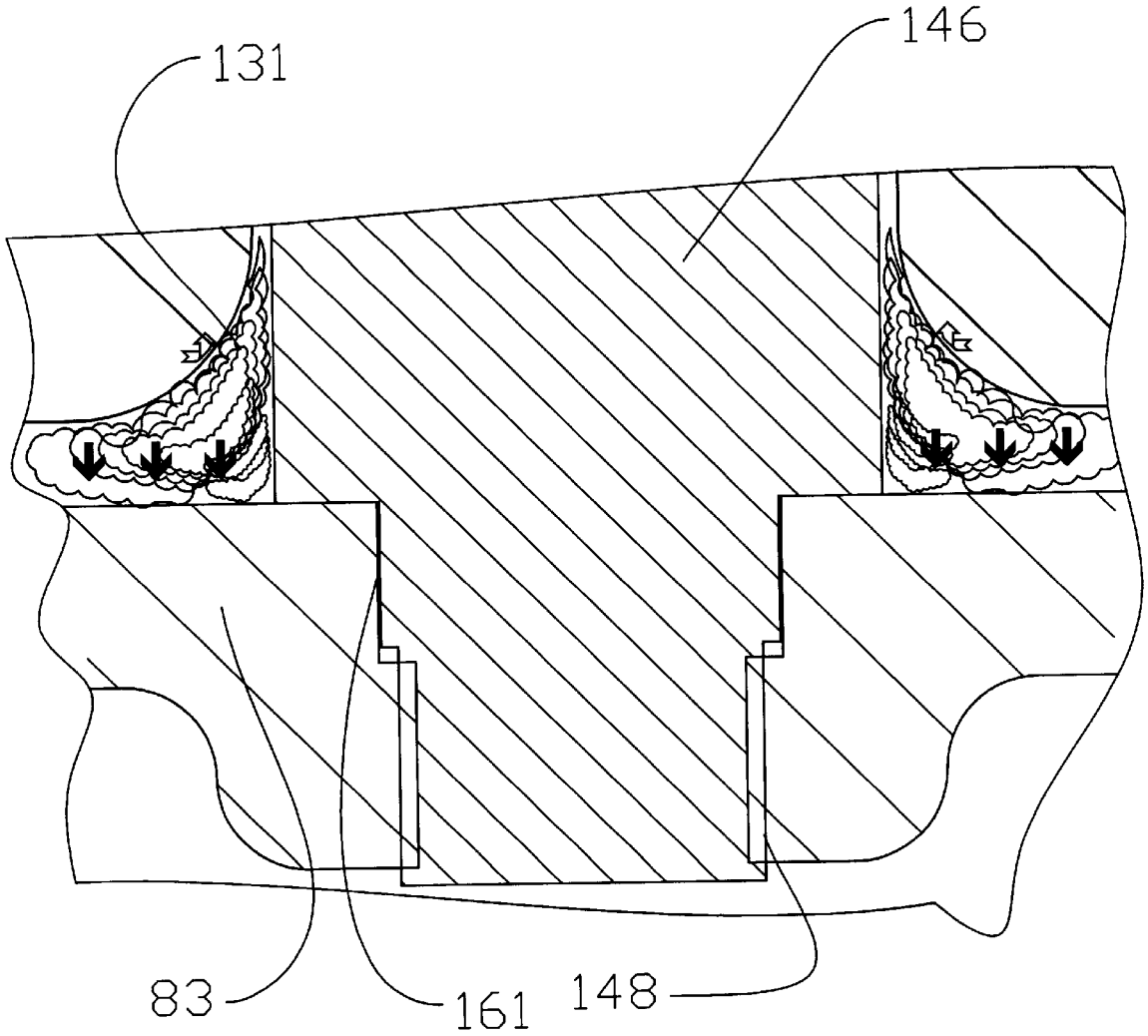
FIG. 18 is a greatly enlarged, fragmentary longitudinal sectional view of the piston dampener.

When piston 83 moves from the tank-fill position illustrated in FIGS. 5 and 10 to the discharge position of FIG. 17, air is compressed between piston 83 and the end cap occupying reduced volume 131 (FIG. 17), thereby dampening movement. As the piston moves upwardly the dampener 146 eventually enters the dampening passageway 161 (FIGS. 5, 10). Air entrapped within shrinking volume 129 is vented through dampening passageway 161 through the fill tube 59 (FIGS. 1, 7) which is controlled by the quick exhaust trigger valve 229. Actuator piston travel is dampened by reduced venting rates caused by dampener 146 entering passageway 161. The dampening provides a cushioning effect that decelerates the retracting piston 83 in combination with spring 128.

Figure 13:
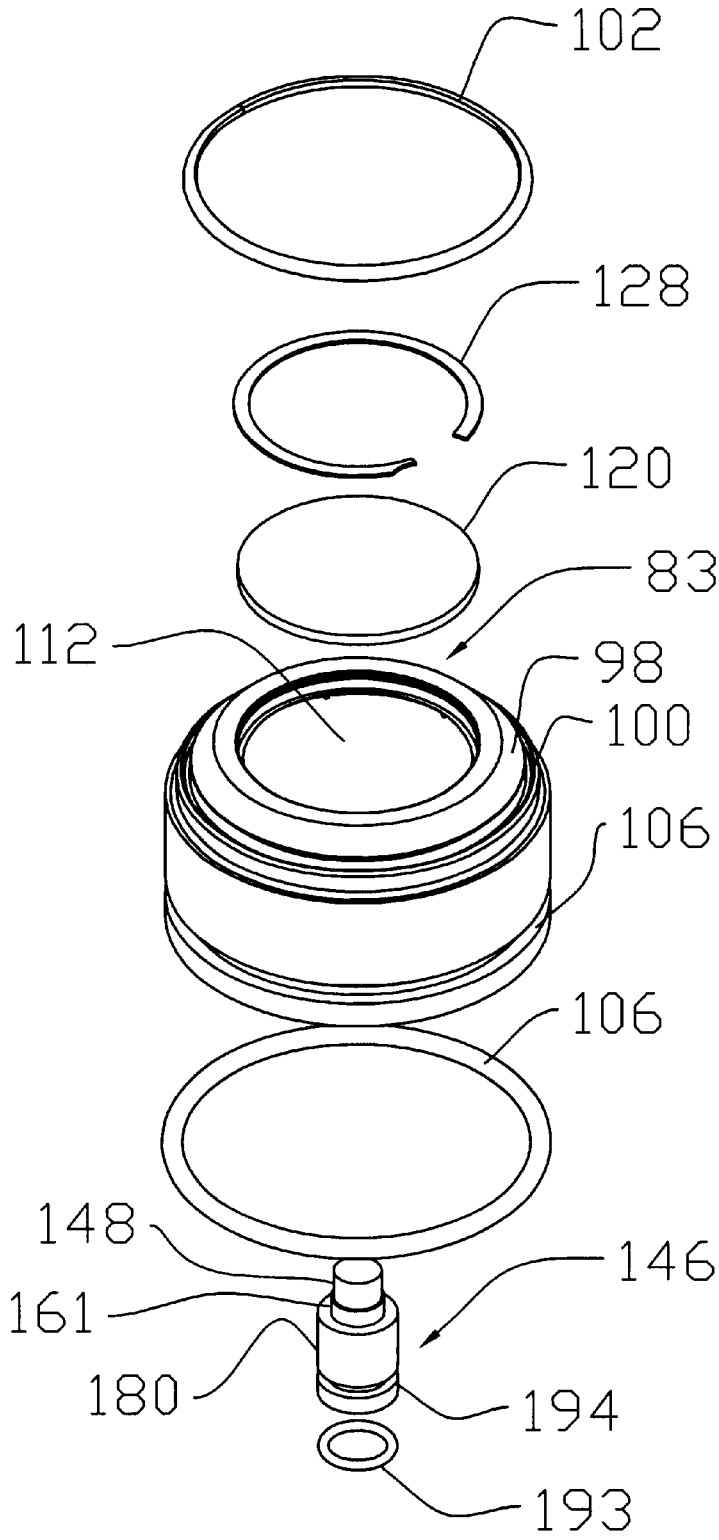
FIG. 13 is an exploded bottom isometric view of the actuator valve piston of FIGS. 11–12.
Figure 14:
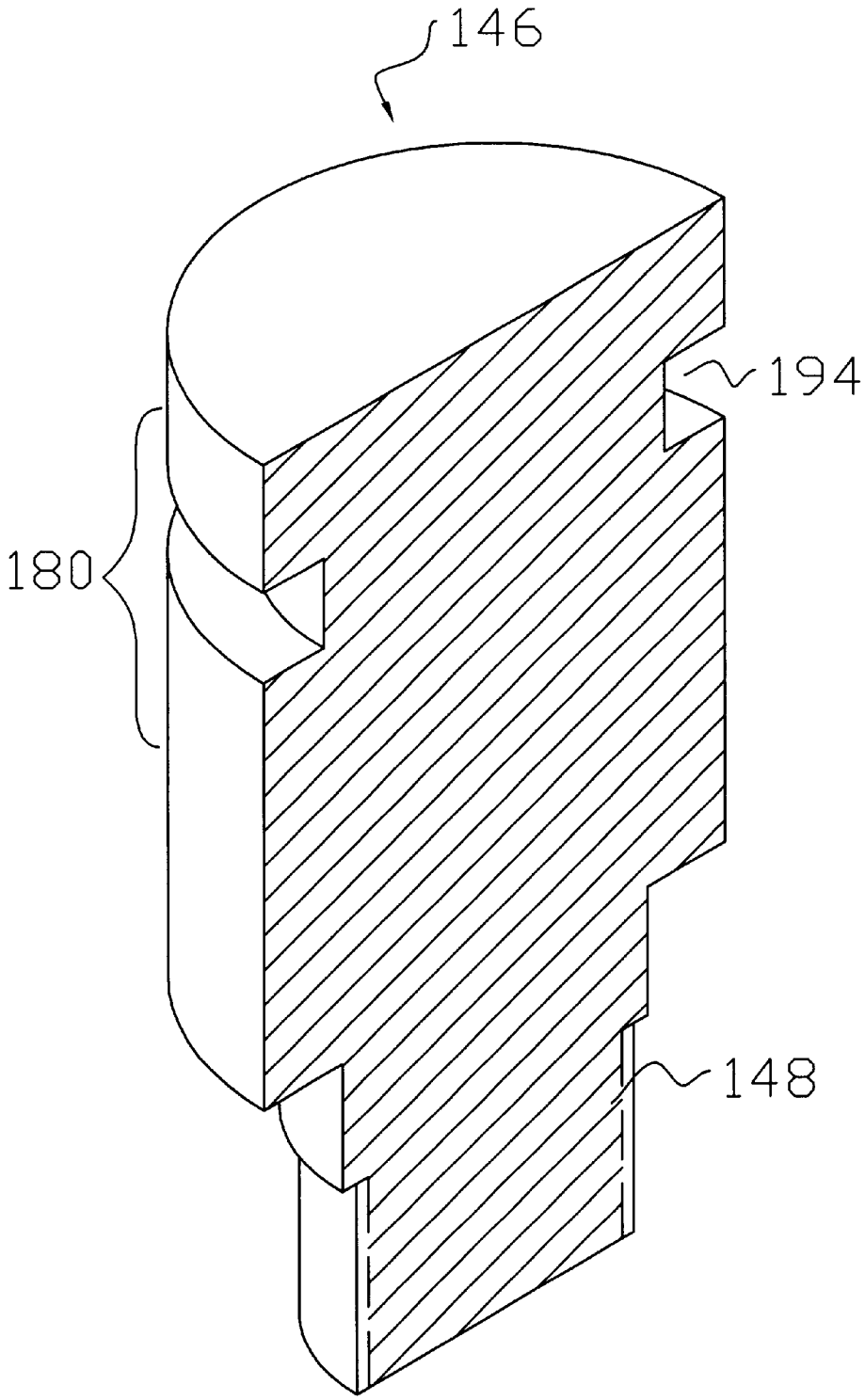
FIG. 14 is an enlarged, isometric and sectional view of the piston dampener.
Figure 15:
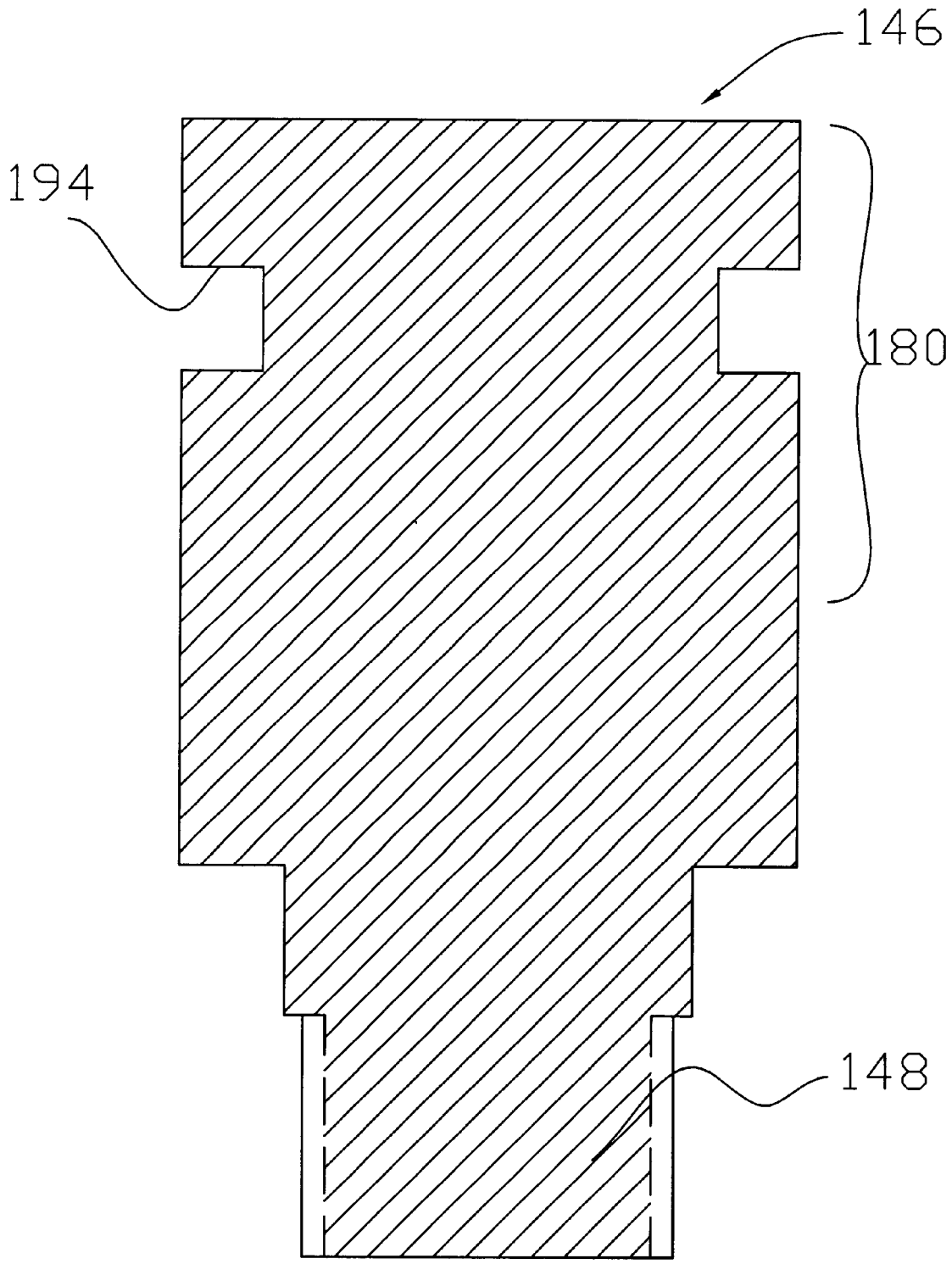
FIG. 15 is an enlarged, longitudinal sectional view of the piston dampener.
Figure 16:
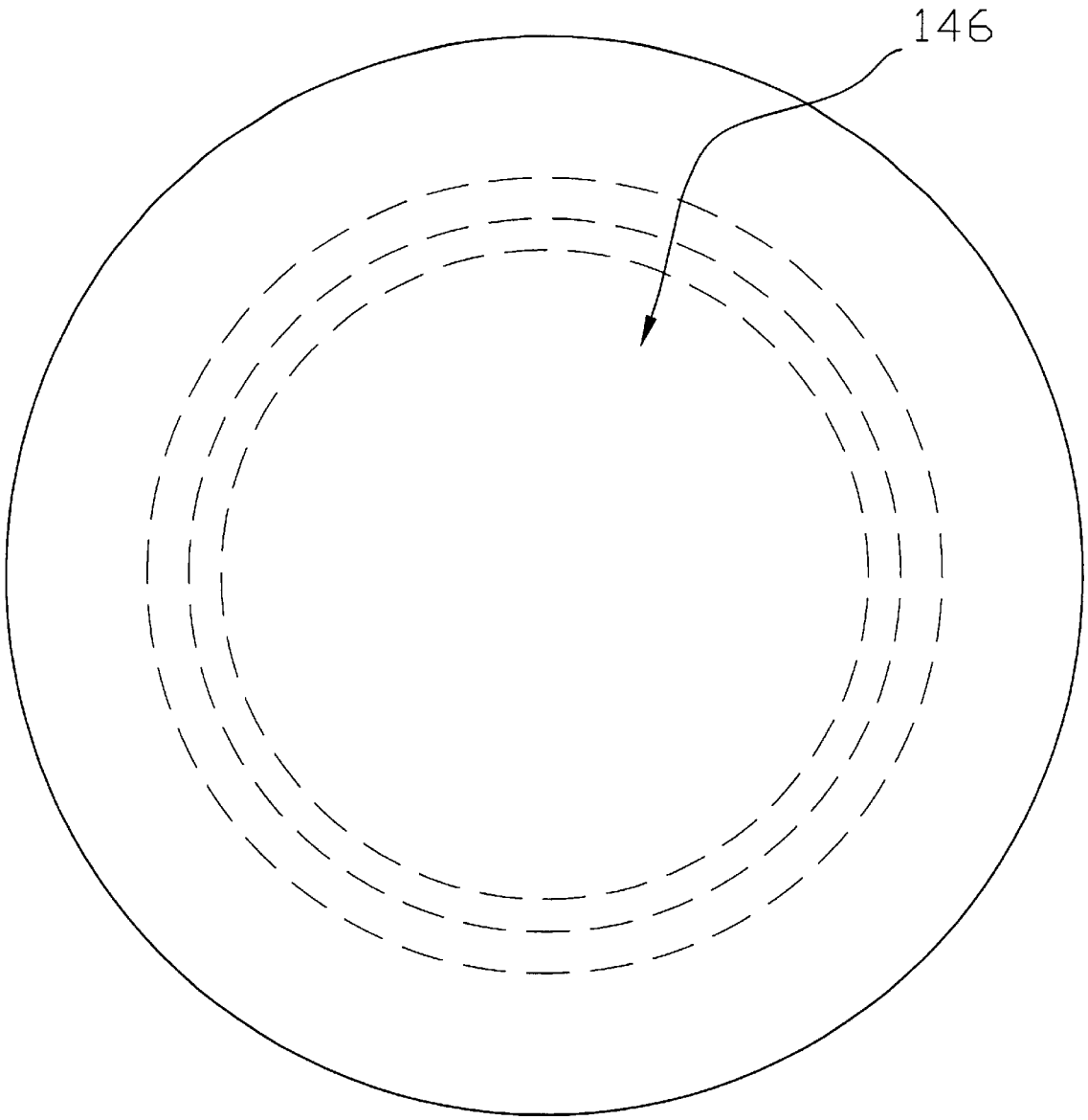
FIG. 16 is a top plan view of the piston dampener of FIGS. 14–15.

Dampener 146 (FIGS. 14–16) comprises a lower diameter portion 148 that is integral with an upper, generally cylindrical portion 180. As seen in FIG. 10, a suitable resilient O-ring 193 (FIG. 13) is seated within groove 194 in dampener 146. As the dampener forcibly moves upwardly in dampening passageway 161 (FIGS. 5, 10) compressed air within dampening passageway 161 is vented through pipe 59, being controlled by quick exhaust trigger assembly 229. Velocities between adjacent surfaces generate considerable pressures that can deform or dislodge O-ring 193.

To fire the aerator, fill tube 59 is depressurized or vented by the trigger assembly 229. High pressure within the tank 22 is exposed to the actuator piston through vents 82. Accumulated tank pressure is sufficient to initially dislodge piston 83 from the fill position when pipe 59 is depressurized or vented. Once air flows through the now-unblocked vents 82, the piston is totally retracted to the discharge position of FIG. 17. It's travel at this time is dampened as explained previously, in part by the dampener 146 sliding within dampening passageway 161 (FIG. 10). Arrows 210, 211 (FIG. 17) indicated airflow continues through vents 82 and pipe 66 to the target application. Once the interior tank pressure is depleted by the blast, piston 83 returns to the fill position 15, and the cycle repeats.

The quick exhaust trigger valve assembly 229 is disposed upon tank 22 at the rear or filling end 34. It is coupled to internal fill tube 36 (FIGS. 1, 3) that leads to actuator valve assembly 23. A conventional source of external, high pressure air is delivered to trigger assembly 229 in the usual manner, via optional series valves and/or electric solenoid valves. Trigger assembly 229 thus allows the blat aerator tank 22 to periodically fill with air, and additionally, it periodically initiates a blast discharge by turning on the spring-less actuator assembly 28.

Trigger assembly 229 (FIGS. 19–21) comprises a machined, dual diameter steel housing 240 of generally cylindrical proportions. Housing shank portion 280 (FIG. 19) extends downwardly to threaded portion 282 that screws into the aerator tank. A central discharge passageway 272 (FIG. 21) in fluid flow communication with internal volume 245 and inlet passageway 249.

Figure 21:
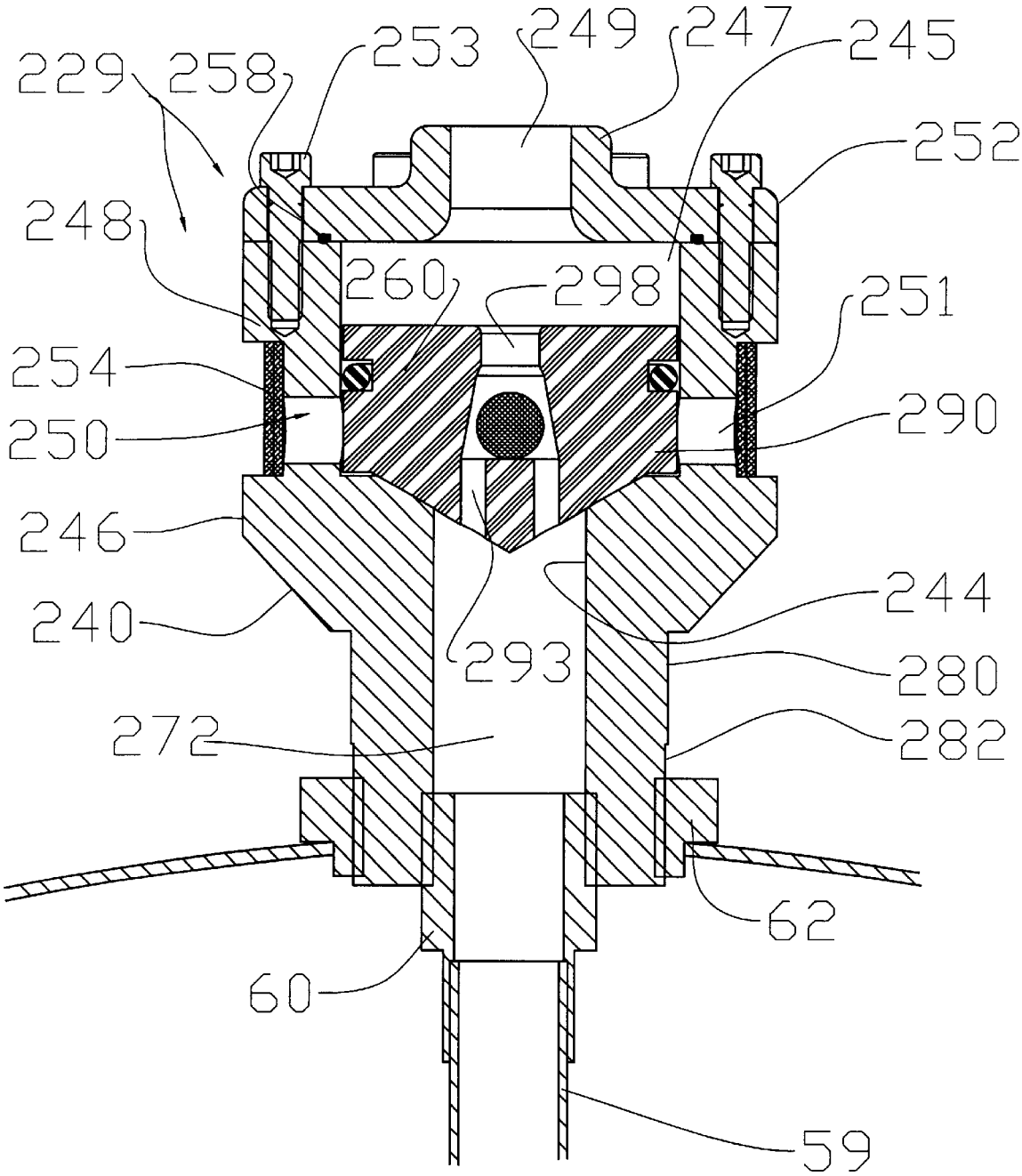
FIG. 21 is an enlarged, sectional and diagrammatic view of the trigger piston and check-valve ball disposed in the aerator filling position.
Figure 23:
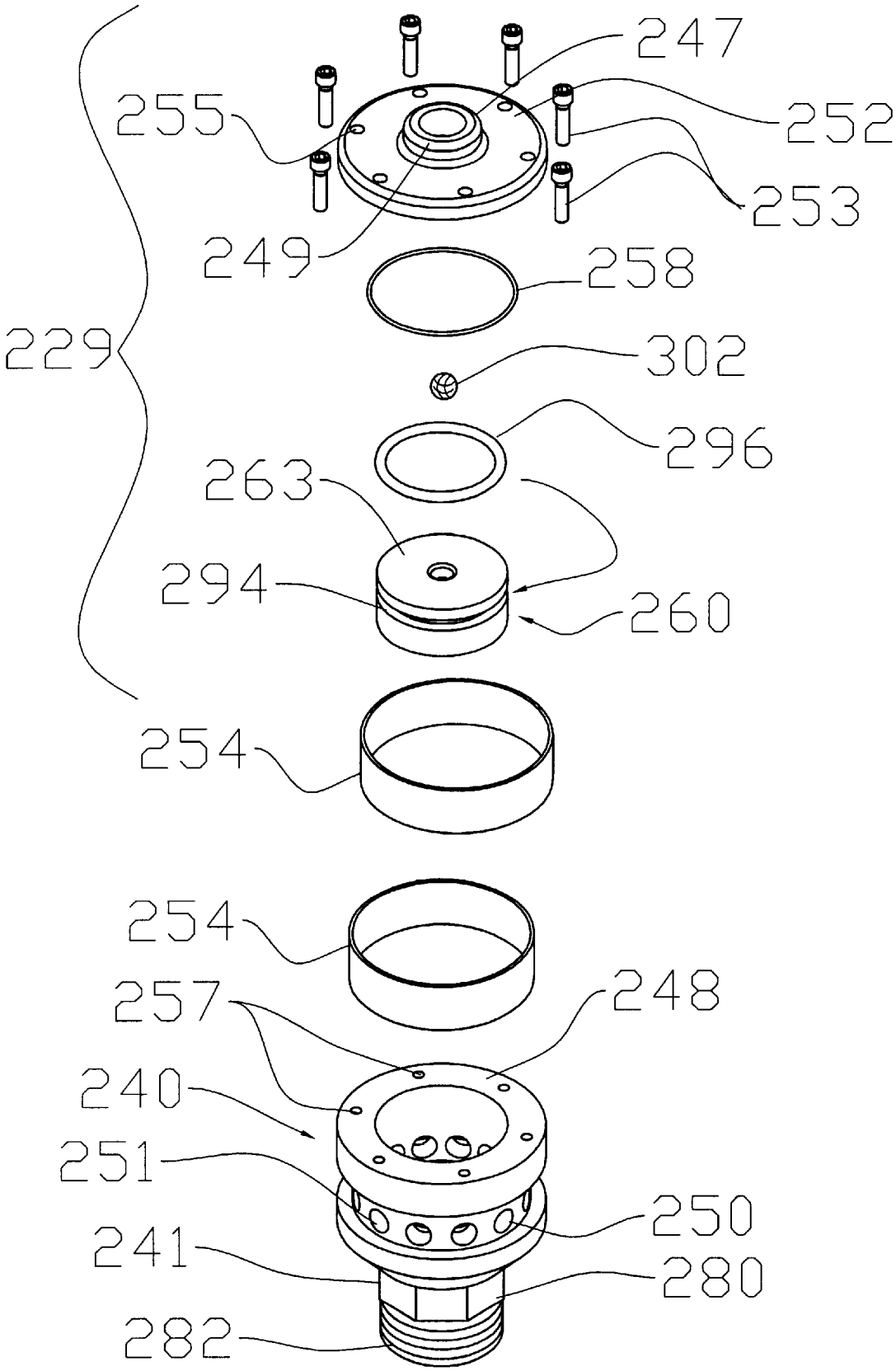
FIG. 23 is an exploded isometric view of the quick exhaust trigger assembly.

Housing 240 comprises a solid neck portion 246 spaced apart from a preferably circular flange portion 248, with a reduced-diameter, central portion 250 (FIG. 21) existing 26 therebetween. Portion 250 comprises a plurality of radially spaced apart passageways 251 that are normally blocked by a pair of overlapping, resilient, preferably rubber, circumscribing bands 254 (FIGS. 21, 23). These deflectable bands forms a one-way check valve, as they can be deflected outwardly (i.e. in a displacement direction perpendicular to the longitudinal axis of the trigger housing region 250) to vent air, but they do not allow air to enter the trigger interior. The passageways 251 oriented perpendicular to the longitudinal axis of the housing, and they communicate with trigger housing interior 245 depending upon the position of piston 260.

The trigger housing rear end comprises a circular flange 248 that receives an annular cap 252 via fasteners 253 with O-ring 258 (FIG. 21) sandwiched therebetween. An integral hub 247 coaxially aligned at the center of plate 252 defines a passageway 249, which is connected to a remote controlling electric solenoid. The trigger assembly 229 is preferably screwed unto the aerator tank 22 as in FIG. 1. The aligned pipes and bushings provide a fluid flow passageway that connects the tank interior 24 (FIG. 1) with the trigger assembly interior 244 and 245 (FIG. 21).

Figure 11:
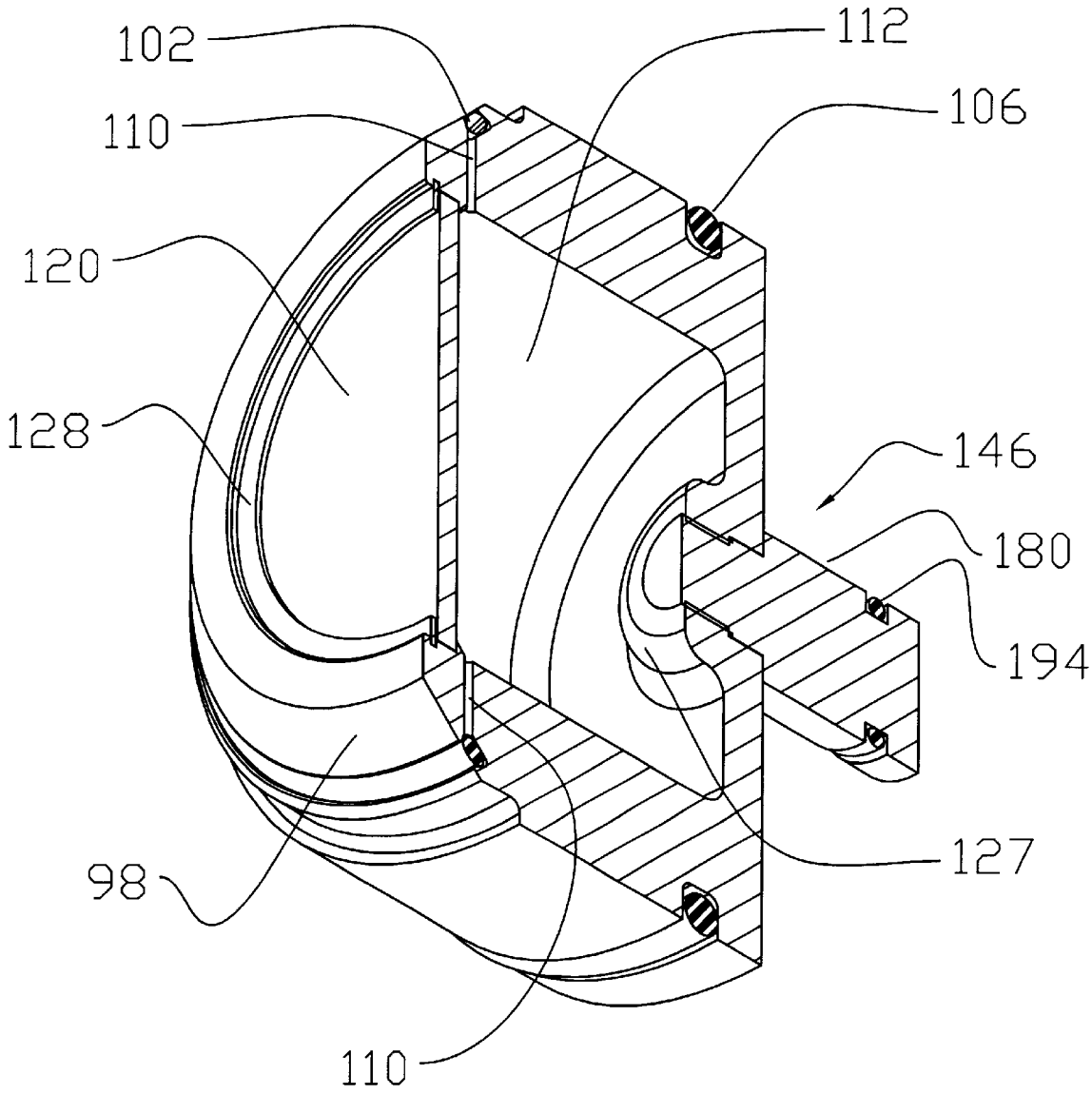
FIG. 11 is a greatly enlarged, fragmentary isometric view of the preferred piston dampener used with the actuator valve assembly.
Figure 12:
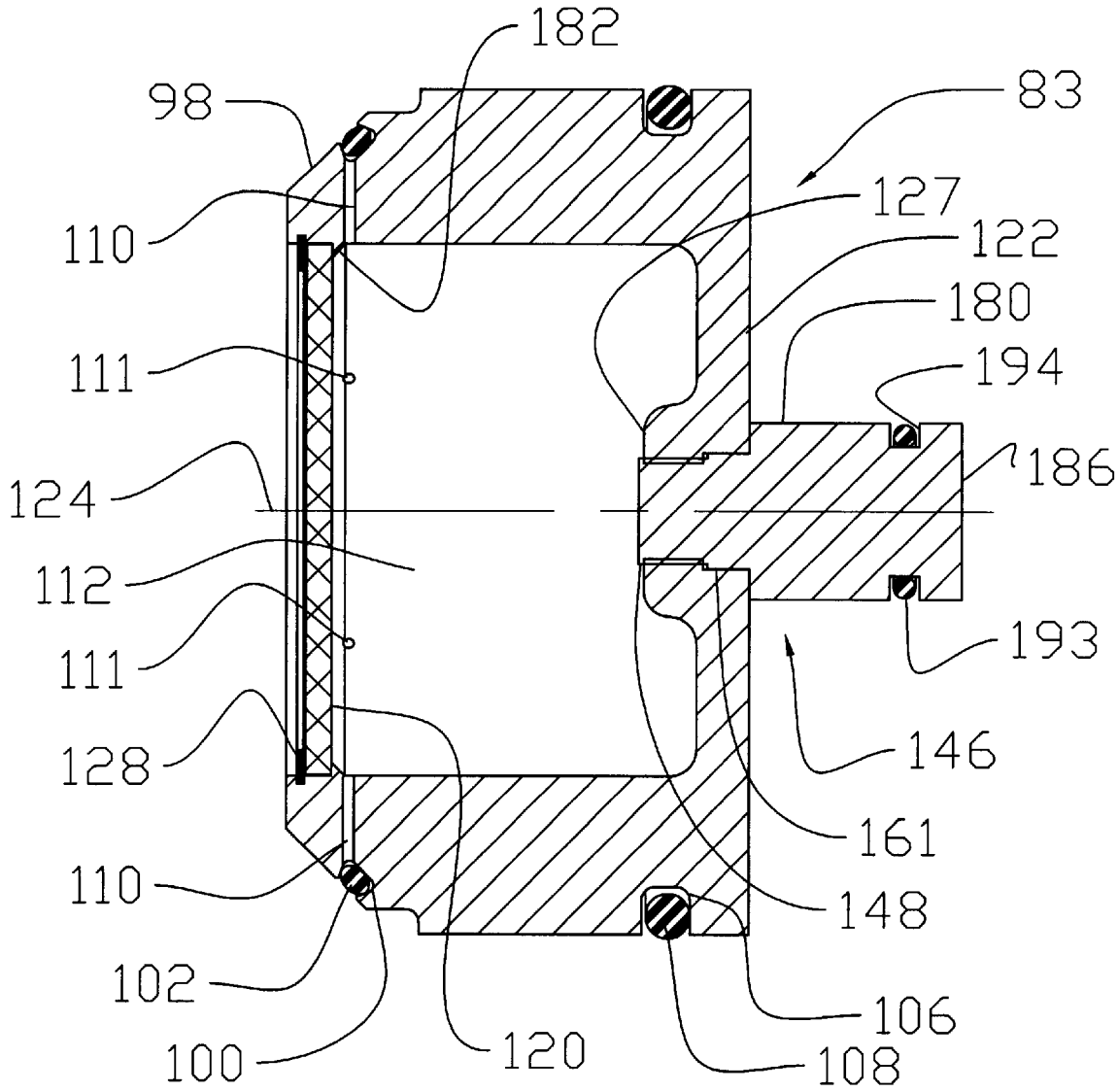
FIG. 12 is a longitudinal sectional view of the piston of FIG. 1I.

The trigger piston 260 is slidably disposed within the housing interior 245 between end cap 252 and body 246. The cylindrical housing interior 245 forms a "cylinder" in which annular piston body 290 is dynamically and coaxially disposed for reciprocal motion. Piston 260 is displaceable between the "fill" position of FIGS. 11, 12, nesting against and within passageway 44, and a retracted actuating position (i.e., FIGS. 16, 17). Piston 60 comprises a generally cylindrical, annular body 90 that is integral with a downwardly-projecting, conical bottom 292. In the fill position the piston conical bottom 92 (FIG. 22) bears against valve seat 322 (FIG. 19), and annular body blocks passageways 251. When disposed in the actuating position, the piston top 260 (FIG. 21) approaches the underside of cap 252.

Figure 20:
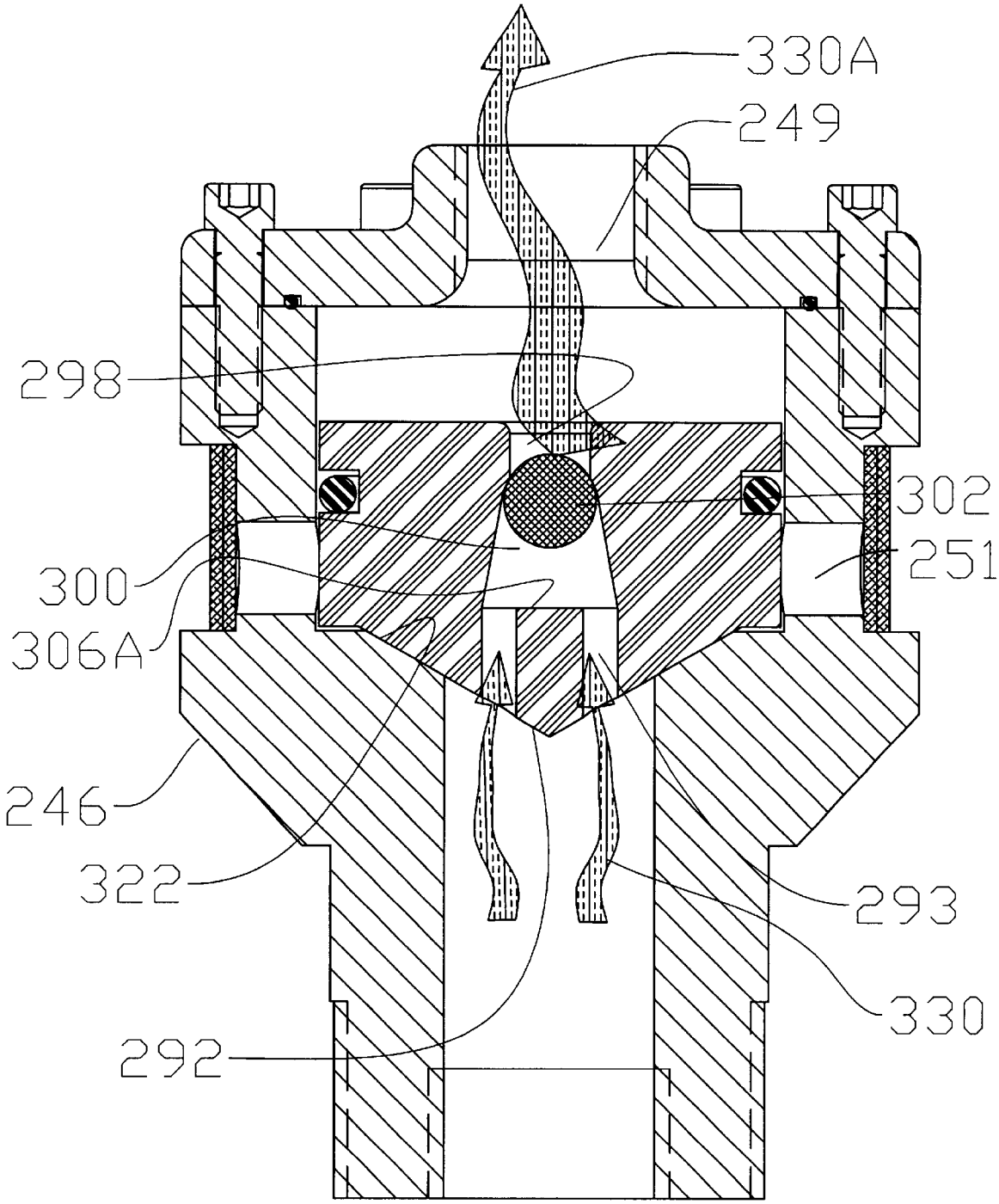
FIG. 20 is an enlarged, sectional and diagrammatic view of the trigger piston and check-valve ball disposed in an intermediate aerator firing position, with portions shown in section for clarity.
Figure 22:
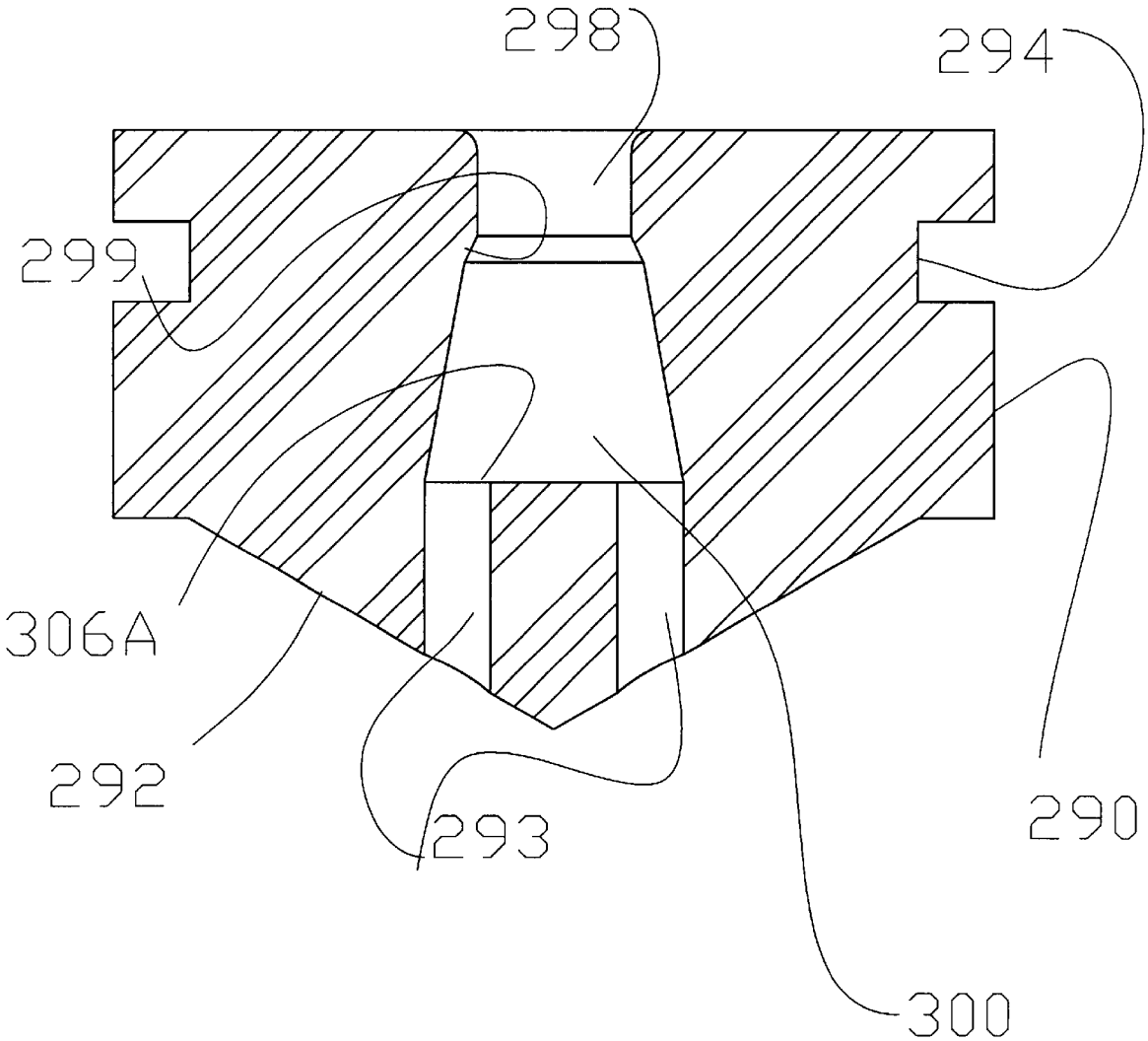
FIG. 22 is an enlarged sectional view of the preferred trigger piston.

A plurality of vertical air passageways 293 (FIG. 22) are defined in piston bottom 292, radially spaced-apart about the longitudinal, axis of the piston. Passageways 293 are in fluid flow communication with the interior piston passageway 298 and the piston chamber 300. As best seen in FIG. 22, the upper portion of the generally trapezoidal chamber 300 forms a valve seat 299. A valve element, preferably a resilient ball 302 (FIG. 23), is trapped within chamber 300, normally free to rest on surface 306A (FIG. 20). Seat 299 forms a boundary with the lower, coaxial chamber 300) that gradually increases in diameter towards the bottom of the piston. Airflow through passageway 298 is blocked when ball 302 is deflected into contact with seat 299. Groove 294 defined in piston body 290 seats a resilient, deflectable O-ring 296 (FIG. 23). The elongated through-passageway 298 is coaxial with the center of the piston.

Figure 19:
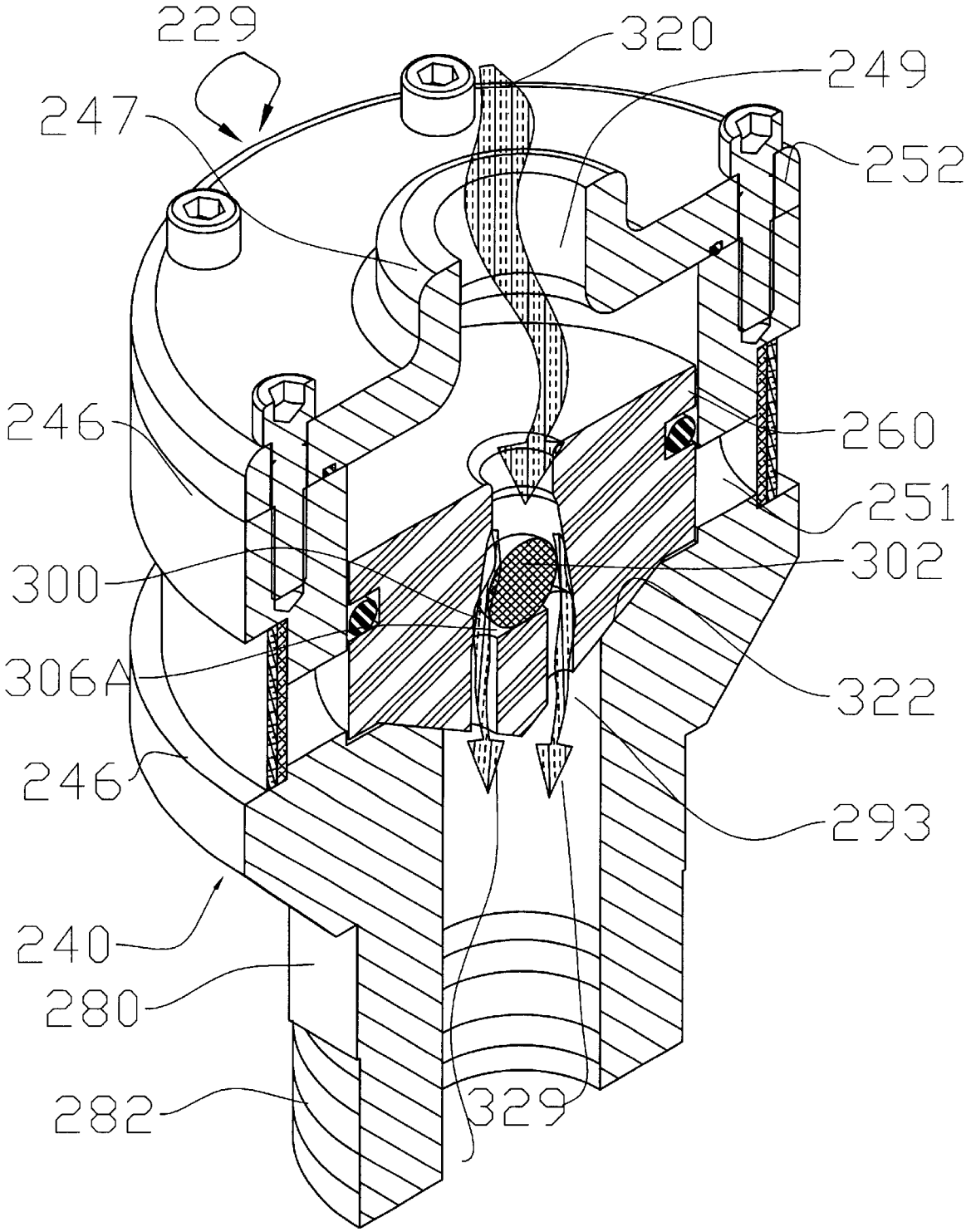
FIG. 19 is an enlarged, isometric and diagrammatic view of the trigger piston and check-valve ball disposed in the aerator filling position, with portions shown in section for clarity.

Operation:

Referring now to FIGS. 19 and 20, air enters passageway 249 via the solenoid as indicated by arrow 320. This pushes piston 260 downwardly into contact with internal valve seat 322 defined within the housing 240. At this time ball 302 is also displaced, and it is deflected downwardly (i.e., as viewed in FIG. 19) out of contact with its seat 299 formed at the top of the chamber 300. Air now passes through the interior of piston 260, exiting vents 229 and entering pipe 59 as indicated by arrows 329 to reach actuator assembly 28. The actuator fills the interior of the blast aerator until the tank 22 reaches a sufficient line pressure. The piston 260 stays sealed because of the piston O-rings and the seat-to-surface seals. Since the area exposed to air pressure is larger on the solenoid side than at the tank side, the piston is held firmly against the seat 322.

When the solenoid depressurizes passageway 249 at the piston rear, check ball 302 pops upwardly into contact with seat 299 and closes. Tank pressure now progressively blows the piston 260 back against housing cap 52 as indicated by arrows 330A and 330 (FIG. 20). Backpressure is vented to atmosphere through radially spaced apart, housing orifices 251 (FIG. 20) as the resilient, surrounding bands 254 deflect. Now pipe 59 (FIG. 1) is depressurized, and the blast aerator valve assembly 23 activates and fires the aerator. Backward movement of its piston is dampened by the combination of trigger piston 260 and its internal check valve formed by ball 302. After detonation, the pressures equalize, and subsequent overpressure applied by the solenoid to passageway 49 again closes the piston for recharging. The cycle continues in the fashion, as governed by the electrical programming of the control solenoid.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A blast aerator comprising:

an air tank adapted to be mounted upon or adjacent a storage bin, hopper or other bulk material container adjacent a source of high pressure air;

an actuator valve assembly for firing said tank, said actuator valve assembly comprising:

a rigid, generally tubular body having an interior, and at least one exhaust vent defined in the body, and a dampening passageway;

a valve seat;

a piston slidably disposed within said body for movement between a sealing, tank filling position engaging said valve seat and a displaced, air discharge position unblocking said at least one exhaust vent, said piston comprising a dampener projecting therefrom which engages said dampening passageway; and, exhaust trigger valve means for quickly firing said aerator by activating said actuator valve assembly, said quick exhaust valve means coupled to said source of high pressure air source and comprising:

a rigid, generally cylindrical housing adapted to be coupled to the air tank, the housing having a hollow interior in fluid flow communication with said high pressure air and an outlet in communication with said actuator valve assembly;

a plurality of vent orifices radially disposed about the periphery of said housing;

a resilient band surrounding the housing and covering the vent orifices to form a one-way check valve that lets air escape from the housing but prevents air from entering the housing;

a resilient, hollow piston coaxially, slidably disposed within said hollow interior of said housing, the piston comprising a hollow internal chamber, an air passageway extending through it, and an internal valve seat coaxial with said air passageway;

a second valve seat defined within the hollow interior of said housing contacted by said piston to close the housing interior when the aerator is to be filled;

a plurality of piston air vents defined in the piston bottom in fluid flow communication with the outlet; and, a valve element captivated within said piston chamber that is displaceable from a loose position within the chamber to a sealed position seating against said first valve seat;

whereby air directed into the quick exhaust valve means pushes the piston into contact with the second valve seat and frees the valve element from contact with the first seat allowing air to pass through the piston to fill the aerator, and, whereby, when the housing is depressurized the piston valve element contacts said first valve seat and resulting rising pressure deflects the piston, exposing the radially spaced-apart vent orifices allowing pressure to escape by deflecting the resilient band to fire the high volume actuator valve assembly.

2. A blast aerator comprising:

an actuator valve assembly for firing said tank, said actuator valve assembly comprising a rigid, generally tubular body having an interior, at least one exhaust vent defined in the body, a dampening passageway; a piston slidably disposed within said body for movement between a sealing, tank filling position engaging said valve seat and a displaced, air discharge position unblocking said at least one exhaust vent, said piston comprising a dampener projecting therefrom which engages said dampening passageways and, quick exhaust valve means for controlling said actuator valve assembly, said quick exhaust valve assembly comprising:

means for receiving air and vacuum from adjacent air inlet means;

a rigid, generally cylindrical housing in fluid flow communication with said means for receiving air and vacuum, a plurality of vent orifices radially disposed about the periphery of said housing;

resilient band means surrounding the housing for covering the vent orifices to form a one-way check valve that lets air escape from the housing but prevents air from entering the housing;

a resilient piston coaxially, slidably disposed within said hollow interior of said housing, the piston comprising a top, a bottom, a hollow internal chamber, an air passageway extending from said top through said chamber towards said bottom, and a first valve seat coaxial with said air passageway;

a second valve seat defined within the hollow interior of said housing contacted by said piston to close the housing interior;

a plurality of piston air vents defined in the piston bottom in fluid flow communication with the piston air passageway; and, a valve element captivated within said piston chamber that is displaceable from a loose position within the chamber to a sealed position seating against said first valve seat;

whereby air directed into the quick exhaust valve means from the air inlet means pushes the piston into contact with the second valve seat and frees the valve element from contact with the first seat allowing air to pass through the piston to fill the application, and, whereby, when the housing is depressurized the piston valve element contacts said first valve seat and resulting rising pressure deflects the piston, exposing the radially spaced-apart vent orifices allowing pressure to escape by deflecting the resilient band to fire the application.

3. The aerator as defined in claim 2 wherein the hollow interior piston chamber increases in diameter between the first valve seat and the piston bottom.

4. The aerator as defined in claim 3 wherein the piston valve element is spherical.

* * * * *